US009867445B2

(12) United States Patent
Ellsworth et al.

(10) Patent No.: US 9,867,445 B2
(45) Date of Patent: Jan. 16, 2018

(54) PACKAGE FOR CONSUMER CARE PRODUCTS

(71) Applicant: The Procter & Gamble Company, Cincinnati, OH (US)

(72) Inventors: Justin Alan Ellsworth, Sharonville, OH (US); Kerry Lloyd Weaver, Florence, KY (US); Christopher Lawrence Smith, Liberty Township, OH (US); Richard Lawrence Horstman, Cincinnati, OH (US); Julie OiLun Lim, West Chester, OH (US); Ricky V. Retherford, Haw River, NC (US); John Joseph Rego, Ripley, OH (US); Tim David Reichling, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 53 days.

(21) Appl. No.: 14/971,842

(22) Filed: Dec. 16, 2015

(65) Prior Publication Data

US 2016/0174683 A1 Jun. 23, 2016

Related U.S. Application Data

(60) Provisional application No. 62/095,088, filed on Dec. 22, 2014.

(51) Int. Cl.

| | |
|---|---|
| ***A45D 40/04*** | (2006.01) |
| ***B65D 25/20*** | (2006.01) |
| *A45D 40/00* | (2006.01) |

(52) U.S. Cl.

CPC ..... *A45D 40/04* (2013.01); *B65D 25/20* (2013.01); *A45D 2040/0012* (2013.01)

(58) Field of Classification Search

CPC ..... A45D 40/04; A45D 40/06; B65D 83/0011

See application file for complete search history.

(56) References Cited

U.S. PATENT DOCUMENTS

| | | | |
|---|---|---|---|
| 3,061,084 | A | 10/1962 | Tibbitts |
| 3,912,403 | A | 10/1975 | Gjerloff |

(Continued)

FOREIGN PATENT DOCUMENTS

| | | | |
|---|---|---|---|
| DE | 31 39 192 | A1 | 4/1983 |
| EP | 0 818 964 | A1 | 1/1998 |

(Continued)

OTHER PUBLICATIONS

International Search Report and Written Opinion of the International Searching Authority , PCT/US2015/065945, dated Mar. 23, 2016, 11 pages.

(Continued)

*Primary Examiner* — Jennifer C Chiang
*Assistant Examiner* — Bradley Oliver
(74) *Attorney, Agent, or Firm* — Kathleen Y. Carter; Betty Joann Zea

(57) ABSTRACT

An array of consumer care products is provided having a first dispensing package and a second dispensing package each having a product chamber with a top opening; an upper dispensing end having a top edge; a major axis, a minor axis, and a sidewall; a top ridged opening at the upper dispensing end of the product chamber, and an outer cap. The first dispensing package also has a seal component that covers the top opening. The second dispensing package also has a perforated dome cover that covers the top opening. The outer caps of the first dispensing package and the second dispensing package are interchangeable with each other. The dispensing packages may have the same source identifier.

23 Claims, 14 Drawing Sheets

(56) References Cited

U.S. PATENT DOCUMENTS

| | | | | |
|---|---|---|---|---|
| 4,664,547 | A * | 5/1987 | Rosenwinkel | A45D 40/04 401/171 |
| 4,865,231 | A | 9/1989 | Wiercinski | |
| 4,950,094 | A | 8/1990 | Yorks | |
| 5,000,356 | A | 3/1991 | Johnson et al. | |
| 5,275,496 | A | 1/1994 | Fattori et al. | |
| 5,547,302 | A | 8/1996 | Dornbusch et al. | |
| 5,725,133 | A | 3/1998 | Iaia | |
| 5,868,510 | A | 2/1999 | Lacout et al. | |
| 5,879,096 | A | 3/1999 | Franta et al. | |
| 5,947,621 | A | 9/1999 | Szekely | |
| 5,961,007 | A | 10/1999 | Dornbusch et al. | |
| 5,967,683 | A | 10/1999 | Fattori | |
| 6,039,483 | A | 3/2000 | Szekely | |
| 6,116,803 | A | 9/2000 | Szekely et al. | |
| 6,143,284 | A | 11/2000 | Bush et al. | |
| 6,299,369 | B1 | 10/2001 | Baines et al. | |
| 6,550,999 | B2 | 4/2003 | Petit et al. | |
| 6,592,278 | B1 | 7/2003 | Holthaus | |
| 6,598,767 | B2 | 7/2003 | Baines et al. | |
| 6,817,799 | B1 | 11/2004 | Petit | |
| 6,820,776 | B2 | 11/2004 | Hemming et al. | |
| 7,374,360 | B1 | 5/2008 | Szekely | |
| 7,389,894 | B2 | 6/2008 | Danne et al. | |
| 8,096,724 | B2 | 1/2012 | Bolander et al. | |
| 8,187,578 | B2 | 5/2012 | Walling et al. | |
| 8,388,249 | B2 | 3/2013 | Groh et al. | |
| 8,511,922 | B2 | 8/2013 | Prischak | |
| 8,690,467 | B2 | 4/2014 | Baines et al. | |
| 8,727,651 | B2 | 5/2014 | Arai et al. | |
| 8,821,056 | B2 | 9/2014 | Walling et al. | |
| 8,875,955 | B2 | 11/2014 | Arora et al. | |
| 8,899,860 | B2 | 12/2014 | Baines et al. | |
| 8,961,048 | B2 | 2/2015 | Baines et al. | |
| 2002/0067949 | A1 | 6/2002 | Melnik et al. | |
| 2004/0206783 | A1 * | 10/2004 | Danne | A45D 40/04 222/390 |
| 2006/0088362 | A1 * | 4/2006 | Chase | A45D 40/04 401/172 |
| 2009/0324317 | A1 | 12/2009 | Batchelor et al. | |
| 2010/0196079 | A1 | 8/2010 | Bolander et al. | |
| 2013/0039687 | A1 | 2/2013 | Bolander et al. | |
| 2014/0154197 | A1 | 6/2014 | Swaile et al. | |
| 2016/0174684 | A1 | 6/2016 | Ellsworth | |
| 2016/0174685 | A1 | 6/2016 | Ellsworth | |
| 2016/0174686 | A1 | 6/2016 | Ellsworth | |
| 2016/0174687 | A1 | 6/2016 | Ellsworth | |

FOREIGN PATENT DOCUMENTS

| | | | |
|---|---|---|---|
| FR | 2 573 734 | A1 | 5/1986 |
| JP | 2011-50521 | A | 3/2011 |

OTHER PUBLICATIONS

International Search Report and Written Opinion of the International Searching Authority , PCT/US2015/065950, dated Mar. 23, 2016, 11 pages.

International Search Report and Written Opinion of the International Searching Authority , PCT/US2015/065952, dated Mar. 23, 2016, 11 pages.

International Search Report and Written Opinion of the International Searching Authority , PCT/US2015/066038, dated Mar. 18, 2016, 11 pages.

International Search Report and Written Opinion of the International Searching Authority , PCT/US2015/066046, dated Mar. 18, 2016, 11 pages.

* cited by examiner

PACKAGE FOR CONSUMER CARE PRODUCTS

FIELD OF THE INVENTION

The present invention relates to packages for consumer care products and methods of manufacturing the same. The packages are particularly suited for antiperspirant and/or deodorant products, but can equally be employed for other types of consumer care products.

BACKGROUND OF THE INVENTION

Traditionally, consumer care products such as antiperspirants and/or deodorant products are packaged in an oval or round plastic barrel component. The top of the barrel is open to allow the product to be exposed and dispensed for use, while the opposite bottom end of the barrel contains a mechanism (e.g., a product support elevator coupled with a hand-rotatable screw) to assist in the dispensing of the product.

Antiperspirant and deodorant compositions are offered by manufacturers in a variety of sizes and product forms such as liquids, creams, gels, semi-solids, and solid sticks. These products have different ingredients, active levels, solvents, viscosities, shapes, and sizes to address a variety of consumer preferences and needs.

Packaging components must be adapted and designed to avoid manufacturing, shipping, storage, and dispensing problems that are associated with these different product offerings. For example different compositions may exhibit different stability profiles, may apply different internal pressures on the package, may require air-tight seals, may cause different degrees of solvent syneresis or weeping, and may require different package components for ease of and consistent dispensing. In addition a perforated dispenser cap is needed for dispensing composition with lower viscosity such as gels and semi-solids to ensure uniform and consistent dosing of the active. For composition that are solids, it is generally acceptable to use only a factory seal component that protects the top surface of the composition during shipping and manufacture, and is removed by the consumer prior to the first use of the product. A factory seal also serves as a seal when the package is filled from the bottom with molten product. After removal of the factory seal a larger composition surface area is exposed and the composition has the right physical spreading properties for consistent dosing.

Manufacturers generally use different outer caps with each of the factory seal and the perforated dome dispenser cap. This requires one or more additional injection molds and/or parts. Thus the use of different caps adds to the complexity, time and expense of the manufacturing process.

In addition manufactures have historically used a large number of injection molding parts to make different packaging components for the various product offerings. As a result, sometimes as many as 50-75 or more different molds must be developed, used, and maintained in the injection molding process, adding significant complexity and expense.

Thus, a need exists for interchangeable package components for dual walled packages made with fewer injection molds. These packages must also exhibit adequate strength, flexibility, aesthetic appearance, and adequate dispensing quality for a variety of product offerings. There is also a need for providing a dual purpose outer cap that may be used alone or interchangeably with either a factory seal component or a perforated dome dispensing cap.

SUMMARY OF THE INVENTION

The present invention is directed to consumer care products and/or packages. In accordance with one of the embodiments, a package for consumer care products and methods of manufacturing the same are provided. The packages are particularly suited for antiperspirant and/or deodorant products, but can equally be employed for other types of consumer care products.

In accordance with another embodiment, an array of consumer care products is provided, comprising:

a. a first dispensing package comprising:
  - a product chamber comprising a top opening; an upper dispensing end having a top edge; a major axis, a minor axis, and a sidewall;
  - a top ridged opening at the upper dispensing end of the product chamber;
  - an outer cap;
  - a seal component that covers the top opening;

b. a second dispensing package comprising:
  - a product chamber comprising a top opening, an upper dispensing end having a top edge; a major axis, a minor axis, and a sidewall;
  - a top ridged opening at the upper dispensing end of the product chamber;
  - an outer cap;
  - a perforated dome cover that covers the top opening;

wherein the outer cap of the first dispensing package is dimensioned to be interchangeable with the outer cap of the second dispensing package and the outer cap of the second dispensing package is dimensioned to be interchangeable with the outer cap of the first dispensing package and the interchangeable outer caps maintain a retention force of about 1.5 lbs. to about 12 lbs.; and wherein the first dispensing package and the second dispensing package have the same source identifier.

BRIEF DESCRIPTION OF THE DRAWINGS

While the specification concludes with claims that particularly point out and distinctly claim the invention, it is believed that the present invention will be better understood from the following description of embodiments, taken in conjunction with the accompanying drawings in which:

DETAILED DESCRIPTION OF THE INVENTION

Figure 1:
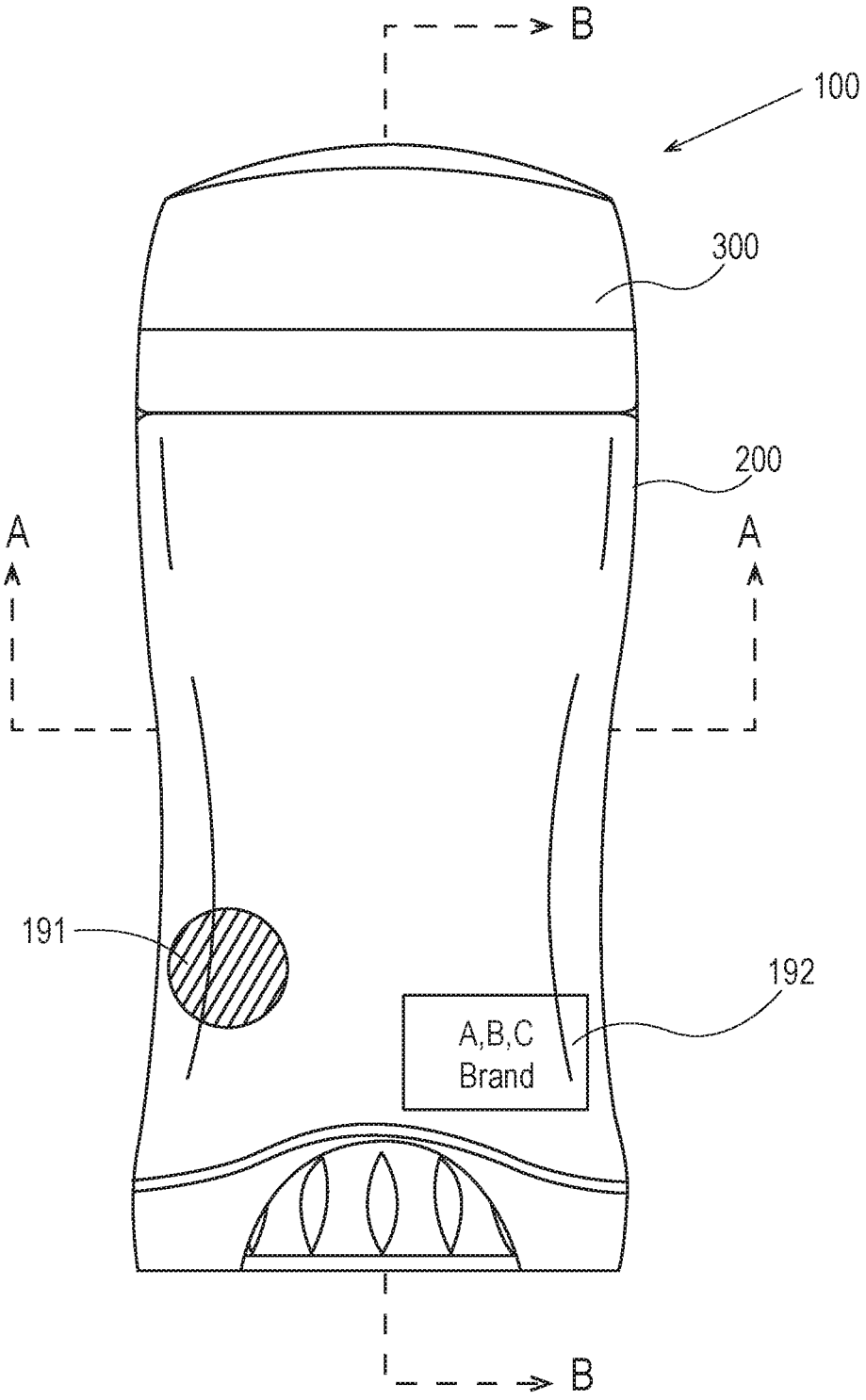
FIG. 1 is a front view of one embodiment of the consumer care product and dispensing package shown and described herein.

While the specification concludes with the claims particularly pointing out and distinctly claiming the invention, it is believed that the present invention will be better understood from the following description.

"Consumer care product", as used herein, also referred to as the "product", refers to any consumer care product including but not limited to beauty care products, personal care products, household care products, health care products, pet care products and the like.

"Antiperspirants", as used herein, includes antiperspirants, deodorants, deodorant/antiperspirants and body sprays, and may also be considered as beauty care products.

As used herein, "transparent" or "visibly clear" is defined as having the property of transmitting light without appreciable scattering so that bodies lying behind are perceivable. One acceptable test method for determining whether a product is clear is to attempt to read a series of words placed immediately behind and contacting one surface of the package, the words being printed in black color, 14 point Times New Roman font, printed on a white sheet of paper. The word and/or letters must be visible and/or readable from the front of the package by an individual using unaided 20/20 eyesight and positioned 12 inches in front of the package in indoor lighting conditions, such as retail outlet lighting conditions.

The term "translucent", as used herein may include "frosted", "glittered", "pearlescence" and the like and is defined herein as the practice of inducing a low level of light scattering into an otherwise "clear" material causing the material to become matted in appearance.

As used herein, "substantially opaque" refers to the ability to sufficiently block the transmission of light so that bodies lying behind are not easily perceivable. Substantially opaque includes "tinted" and is defined herein as the practice of adding a low level of pigment or dye into a material for the purpose of imparting a color into the material.

As used herein, "identifier" relates to a means for communicating between the consumer and the consumer care product such that the consumer may readily identify the consumer care product and its associated traits, including, but not limited to product form, product performance, scents and the like. Identifiers of the present invention may include, but are not limited to, pressure sensitive labels; shrink wrap labels; indicia; colors or other visually detectable or discernable aspects (e.g., "sparkles" or "glitter" via incorporation of interference pigments) that are part of the material from which the packaging components are made or that is subsequently added to the manufactured components; defined relief, indentation, windows and/or gaps formed in the components during or after their manufacture; cast designs, including but not limited to novelty casting to identify characters, paraphernalia, animals, and the like; particular shapes or other means of decoration and/or information sharing used to identify and distinguish the product. The identifiers may be formed concurrently with the manufacture of the components with which they are associated, may be introduced during the manufacture of the components, and/or may be formed or applied to the components after the components are manufactured. The identifiers of the present invention may be the same or different from one another.

As used herein, "novelty cast" may include, but is not limited to, casts/shapes that replicate cars, sport balls, animals or people figures, characters, logos, sport paraphernalia (e.g., helmets, bats, jerseys, shoes and the like), fashion accessories and the like.

The terms "semi-permanent" and "permanent" are used herein to describe the nature of how packaging components are engaged with one another. Components that are semi-permanently or permanently engaged with one another are intended to remain with a consumer care product when it is being used. That is, the packaging components are not intended to be removed and discarded prior to using the accompanying consumer care product. Semi-permanent engagement means that the components are designed and configured to permit disengagement, while permanent engagement means that the components are designed and configured to remain connected but could become unconnected through force and/or by destroying or disfiguring the components.

By "brand sub line" it is meant a line of products that are targeted to a particular consumer sub-group, provides a real or perceived distinctive benefit, and/or manifests a real or perceived distinctive attribute. By way of example, a consumer care product may be an antiperspirant/deodorant product with the sub lines including, a sensitive skin line, a botanical line, a high performance/high efficacy line, and a no fragrance line. Another example of sub lines may include a "treatment" line that comprises treatments to address extreme personal care conditions (e.g., malodor, excessive perspiration (hyperhidrosis), excessive dandruff, excessive dryness or oiliness), a "high performance" line that targets superior performance as compared to other offered products, an "essentials" line that provides value-added, trusted or reliable performance, and an "expressives" line that provides sensorial experiences with reliable performance. There may be a single product form or multiple product forms within a given sub line. For example, antiperspirant and deodorant products can come in a variety of forms, including solids, soft solids, gels, and roll-ons. Various sub lines may include the same or different product forms and may include the same number or a different number of product forms. The consumer care product may include a single source identifier (e.g. single brand name) for the multiple sub lines.

FIG. 1 is a front elevation of one embodiment of the dispensing package of a consumer care product of the present invention as fully assembled. The dispensing package 100 further comprises an outer cap 300, an outer jacket 200, a single source identifier 192, and an identifier 191.

Figure 4:
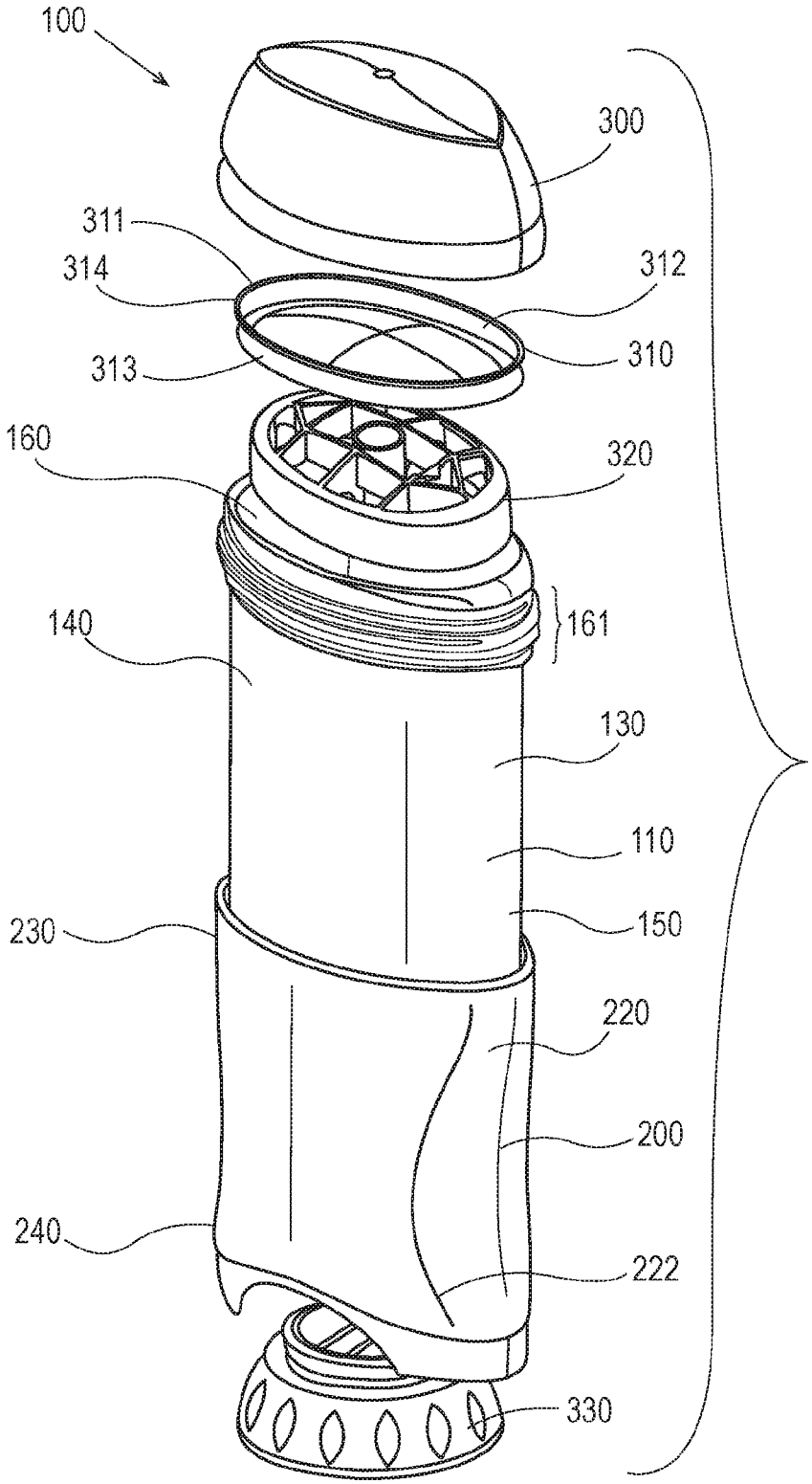
FIG. 4 is an exploded perspective view of FIG. 1 of a dispensing package for a consumer care product shown and described herein, illustrating some of the individual components and having a form suitable for bottom filling.

FIG. 4 is an exploded perspective view of FIG. 1 of a dispensing package for a consumer care product shown and described herein, illustrating some of the individual components.

FIG. 4 shows generally one embodiment wherein the dispensing package 100 of the present invention may comprise at least one product chamber 110 and an outer jacket 200 for dispensing a consumer care composition. The dispensing package 100 further comprises an outer cap 300, optionally a seal component 310, a movable elevator platform 320 (shown in FIGS. 5, 6, 9 and 10), and a screw assembly 330.

Figure 3:
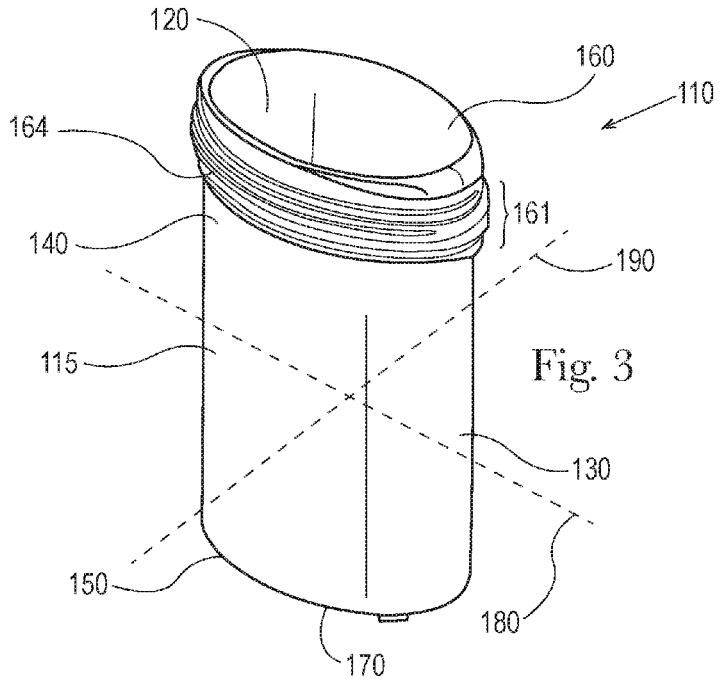
FIG. 3 is a front perspective view of one embodiment of the product chamber shown and described herein showing the major axis and the minor axis.
Figure 7:
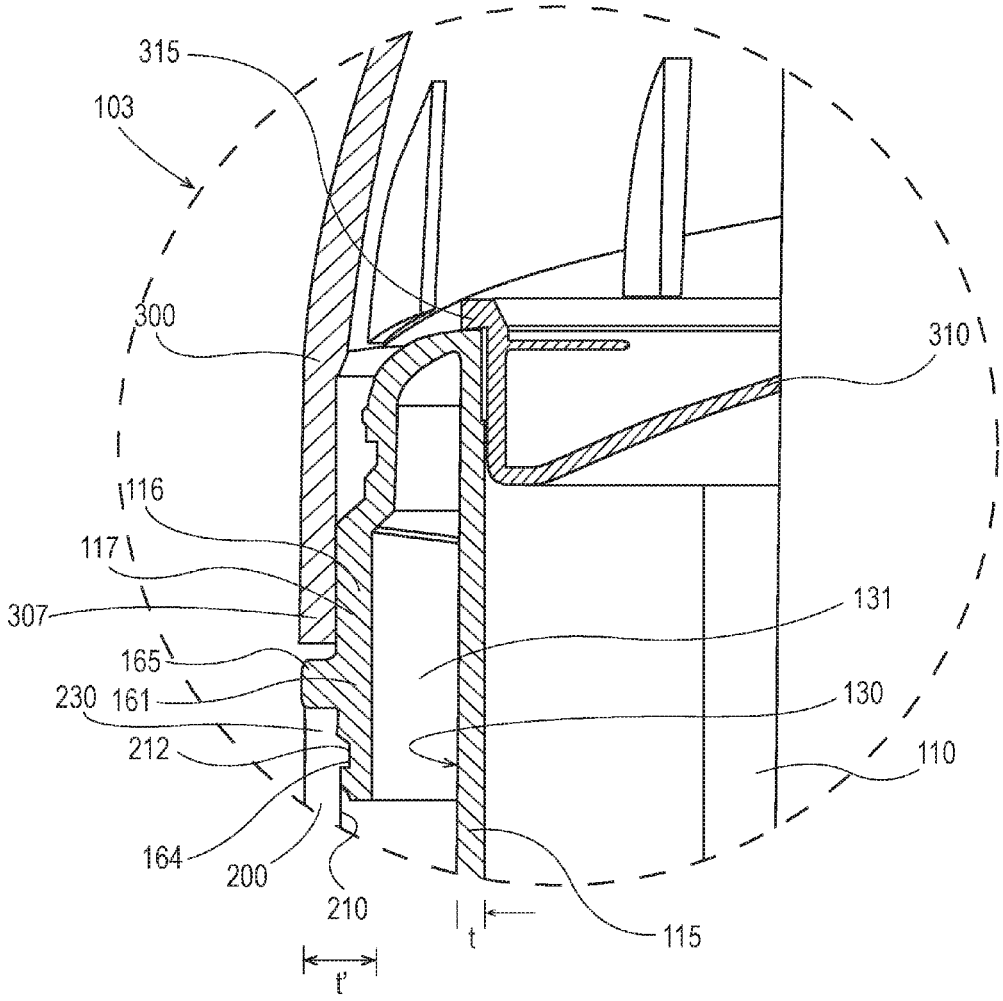
FIG. 7 shows detail C of FIG. 5 on an enlarged scale.

As shown in FIGS. 3 and 4 an exemplary dispensing package 100 has a product chamber 110 further comprising at least one side wall 115 having an inner surface 120 that at least partially surrounds and supports a consumer care composition, and an outer surface 130, an upper dispensing end 140, a lower end 150, top opening 160 wherein the composition moves up and outward, a top ridged opening 161, a bottom opening 170, major axis 180, minor axis 190 and a thickness t (shown in FIG. 7). In one embodiment the thickness t of the sidewall 115 is from about 0.45 mm to about 1.2 mm, in another embodiment from about 0.5 mm to about 1.15 mm and in another embodiment from 0.7 mm to about 1 mm. In an embodiment the thickness t of the product chamber may be substantially uniform or may substantially non-uniform.

The consumer care composition may be in the form of a solid, semi-solid, liquid, gel, mousse or the like. Held within the surrounding walls, particularly the inner surface 120 of the product chamber 110, the composition may be dispensed from the top opening 160 of the product chamber 110 and from the top ridged opening 161, both located at the dispensing end 140 of the product chamber 110. For example, the product chamber 110 may comprise a top ridged opening 161 having a major axis 162 and a minor axis 163 (same as the major axis 180 and minor axis 190 of the product chamber).

Figure 5:
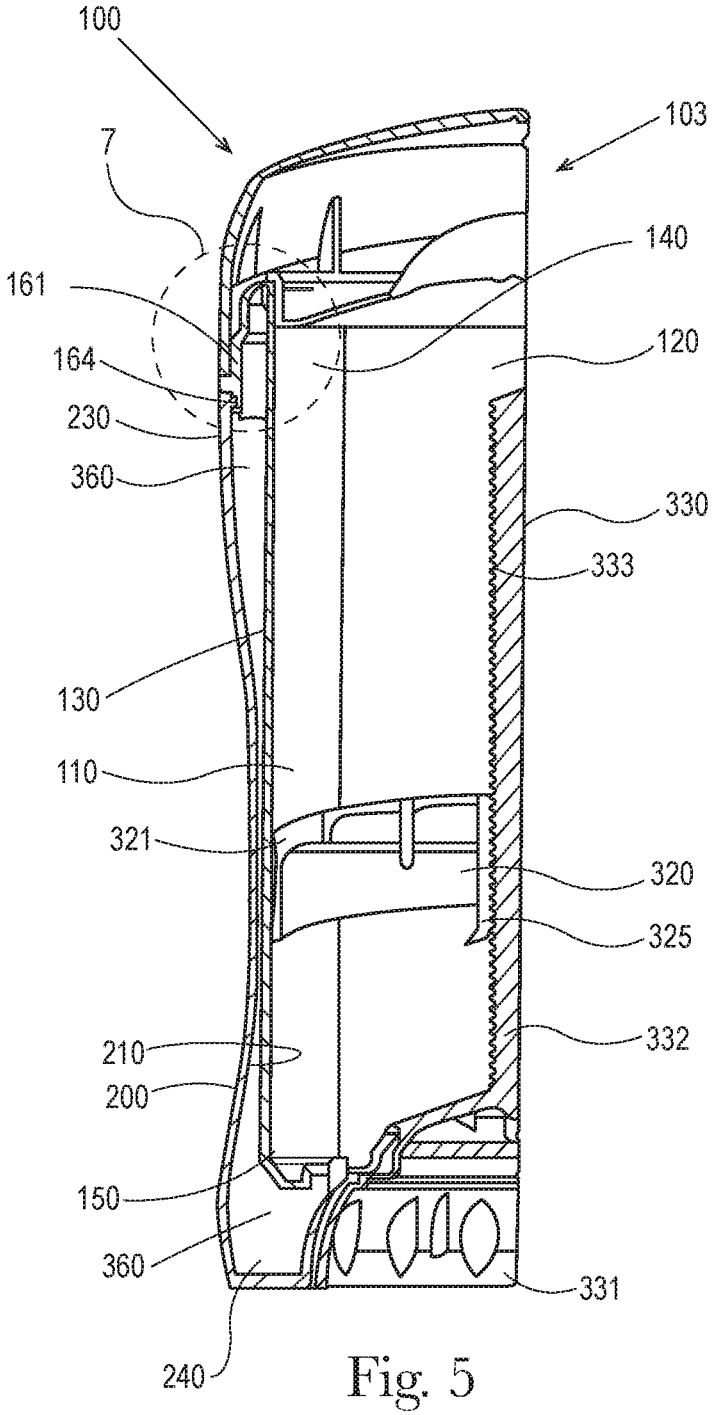
FIG. 5 is a partial cross-sectional front view of one embodiment of the dispensing package taken along the major axis A-A of FIG. 1.

In FIGS. 3, 5 and 7 the upper dispensing end 140 of the top ridged opening 161 of the product chamber 110 may further comprise a curved downward extension 116 of the sidewall 115 to form a free end 117. The free end may have a thickness t' that is substantially uniform or substantially non-uniform. In one embodiment shown in FIG. 7 the product chamber 110 further comprises a gap 131 formed by the curved downward extension 116 of the sidewall 115 to form the free end 117, the gap extending along the major axis between the free end 117 and the outer surface 130 of the product chamber toward the upper dispensing end 140 of the product chamber 110. In an embodiment the gap 131 extends predominantly along the major axis of the product chamber. In another embodiment the gap 131 does not significantly extend along the minor axis of the product chamber and in another embodiment the gap 131 does not extend along the minor axis of the product chamber.

Figure 2:
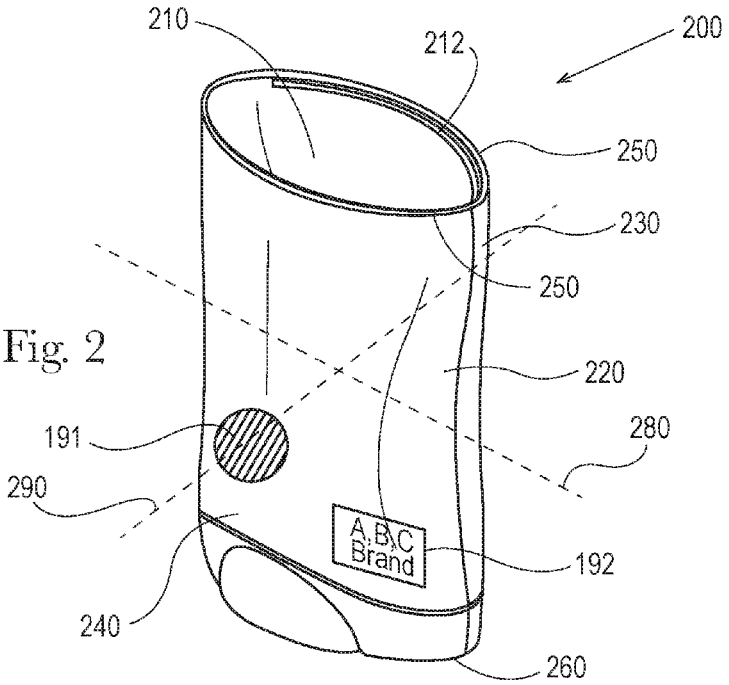
FIG. 2 is a front perspective view of one embodiment of the outer jacket shown and described in FIG. 1 showing the major axis and the minor axis.

As shown in FIGS. 1, 2 and 3 an exemplary dispensing package 100 has an outer jacket 200 further comprising at least one wall having an inside surface 210 that at least partially surrounds and further supports the product chamber 110. The outer jacket 200 further comprises an outside surface 220, an upper end 230, a lower end 240, a top opening 250, a bottom opening 260, a major axis 280, and a minor axis 290. The top opening allows the composition to be dispensed via the product chamber 110 outside of the outer jacket 200. The outside surface 220 of the outer jacket 200 may further comprise an identifier 191 and a source identifier 192. The outer jacket 200 further comprises a thickness "T" shown in FIG. 8. In one embodiment the thickness T is from is from about 0.45 mm to about 1.2 mm, in another embodiment from about 0.5 mm to about 1.15 mm and in another embodiment from 0.7 mm to about 1 mm. In an embodiment the thickness T may be substantially uniform or may substantially non-uniform. FIGS. 2 and 3 may be used for the first product 101 and the first dispensing package 103, and the second product 102 and the second dispensing package 104.

The inside surface 210 of the outer jacket 200 may comprise at least one rib 212, shown in FIG. 2, or other conventional means of engagement with the product chamber 110. For example, in FIG. 2 the rib 212 on the inner surface of the outer jacket 200 engages with a groove 164 in the top ridged opening 161 (FIGS. 3, 5 and 7) of the product chamber 110 in order to keep the product chamber 110 engaged with the outer jacket 200. In an embodiment the outer jacket is semi-permanently or permanently engaged with the product chamber. In another embodiment the semi-permanent engagement of the outer jacket and the product chamber provides a retention force of about 1.5 lbs. to about 50 lbs, and/or about 10 lbs. to about 30 lbs.

As shown in FIGS. 2, 3, 4, 5, and 7, the outer surface 130 of the product chamber 110 includes a top ridged opening 161 that may extend around the outside circumference of the outer surface 130 of the product chamber 110, and in one embodiment, comprises one or more grooves 164 or groove-like discontinuities therein. When the product chamber 110 and outer jacket 200 are assembled, the ribs 212 of the upper end 230 of the outer jacket 200 engage with one or more of the grooves 164 of the product chamber 110, the ribs 212 forming a connection with the product chamber 110 that may be semi-permanent or permanent. In one or more embodiments it is desirable that the connection formed between the grooves 164 of the product chamber 110 and the ribs 212 of the upper end 230 of the outer jacket 200 is a semi-permanent connection. In one or more embodiments, it is contemplated that neither the ribs nor the grooves in the upper dispensing end of the produce chamber with which they engage exert a significant retention force on the other. It is also contemplated that, in one or more embodiments, no significant stress is applied between the grooves and the ribs when engaged.

The connection between the ribs of the outer jacket and the grooves of the product chamber is such that there is sufficient room for the connection to accommodate or "absorb" dimensional variations that result in the product chamber and/or outer jacket being slightly longer or shorter than the standard to which they are designed, for example, as a result of material variations or injection molding. The connection between the grooves of the product chamber and the ribs on the inside surface of the outer jacket desirably builds dimensional tolerance into the subject dispensing package.

In one or more embodiments the ribs 212 of the inside surface 210 of the outer jacket 200 are configured to allow the grooves 164 of the product chamber 110 to pass or slide under the same without a permanent fastening feature that binds such rib(s) and groove(s) together. For example, the outside edge of the ribs of the outer jacket may be chamfered, and the grooves of the product chamber may be provided with a gap or reverse chamfer with which the ribs of the outer jacket may join or mate.

Figure 6:
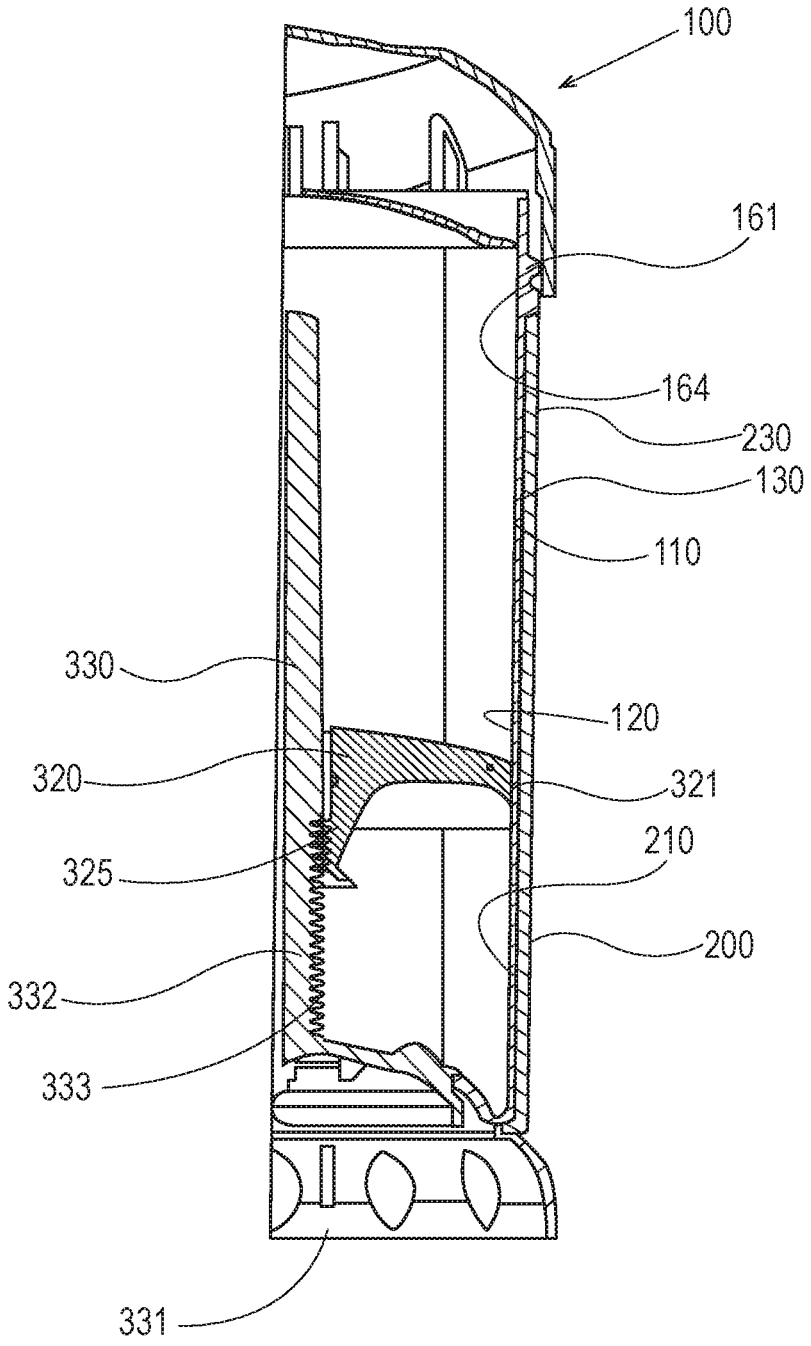
FIG. 6 is a partial cross-sectional side perspective view of one embodiment of the dispensing package taken along the minor axis B-B of FIG. 1.

FIG. 5 is a partial cross section taken along the major axis A-A of FIG. 1 of the dispensing package. FIG. 6 is a partial cross section taken along the minor axis B-B of FIG. 1.

Referring to FIGS. 5 and 7 the dispensing package 100 comprises a product chamber 110 having an outer surface 130, a top ridged opening 161 at the upper dispending end 140 of the outer surface 130, a groove 164 along the outer surface. The upper dispensing end 140 of the top ridged opening 161 of the product chamber 110 may further comprise a curved downward extension 116 of the sidewall 115 to form a free end 117. The free end 117 may have a thickness t' that is substantially uniform or substantially non-uniform. In one embodiment the product chamber further comprises a gap 131 formed by the curved downward extension 116 of the sidewall 115 to form the free end 117, the gap extending along the major axis between the free end 117 and the outer surface 130 of the product chamber 110 toward the upper dispensing end 140. In an embodiment the gap 131 extends along the major axis of the product chamber but does not significantly extend along the minor axis of the product chamber.

Referring to FIGS. 5 and 7 the sidewall 115 of the product chamber 110 may have a thickness t. Also, an outer jacket 200 has an inside surface 210. In one embodiment the inside surface 210 of the outer jacket 200 has one or more ribs 212 along the inside surface 210 of the upper end 230 of the outer jacket 200. The product chamber 110 has a lower end 150, and the outer jacket 200 has a lower end 240, wherein the lower end 240 extends beyond the lower end 150 of the product chamber.

As also shown in FIG. 5 in an embodiment the dispensing package 100 comprises at least one gap region 360 defined along the major axis between the product chamber 110 and along the major axis of the outer jacket 200. Exemplary gap regions 360 are shown in FIG. 5. The one or more gap regions may simply contain air, or may contain certain materials. For example, the gap region may contain an identifier that is not associated with either the product chamber or the outer jacket, as is discussed herein. The identifier can be in the form of a printed material, a solid, a liquid, and combinations. By way of example only, the identifier can be a plurality of single or multiple colored beads, or a plurality of elements that employ a size, shape, or color that is intended to communicate a scent (e.g., discrete flower-shaped elements), level of strength, efficacy level or other product attribute to perspective buyers. The gap region may also contain novelty or purely aesthetic items that consumers like or can relate to when choosing a consumer care product, but that do not necessarily communicate product attributes.

The one or more gap regions 360 may alternately contain material that is intended to be used with or accessed and used by consumers. For example, the gap regions may contain an air freshener to freshen a bathroom environment where the product is stored.

In an embodiment the gap regions may be configured, expanded, or reduced, to produce varied shapes to the dispensing package without a substantial increase in the amount of packaging material utilized while using the same or consistent dimensions and thickness of the product chamber.

At least one gap region 360, may extend a distance to be measured from the outer surface of the product chamber 110 along its major axis to the inside surface of the outer jacket 200 along its major axis. The gap region may extend a distance from about 2 mm to about 5 mm, and/or from about 2.5 mm to about 5 mm Also shown in FIG. 5 is a screw assembly 330 comprising a screw base 331 (or external rotary grip), and a spindle 332 that supports a plurality of helical threads 333. Also shown is a movable elevator platform 320 comprising an outer periphery 321 that is in frictional contact along the inner surface 120 of the product chamber 110 as the screw base 331 is rotated about its axis to advance the movable elevator platform 320 up or down along a coupling sleeve 325, also shown in FIGS. 9 and 10.

FIG. 6 is a partial cross section taken along the minor axis B-B of FIG. 1. Referring to FIG. 6 the dispensing package 100 comprises a product chamber 110 having an outer surface 130, a top ridged opening 161 at the upper end of the outer surface 130, a groove 164 along the outer surface. Also, an outer jacket 200 has an inside surface 210. As also shown in FIG. 6 in an embodiment the dispensing package 100 does not comprise any gap regions defined between the product chamber 110 (along the minor axis) and the outer jacket 200 (along the minor axis). In an embodiment thus the outer surface 130 of the product chamber 110 is in frictional contact with the inside surface 210 of the outer jacket 200 along the product chamber minor axis. As used herein "frictional contact" means direct contact and/or small spacing, inherent to the injection molding processes which uses injection molded parts, of less than, for example, about 0.4 mm, or from about 0.01 to about 0.4 mm or from about 0.01 mm to about 0.2 mm. The dispensing package may thus further comprise a spacing between the outer surface of the product chamber and the inside surface of the outer jacket along at least a portion of the minor axis of the product chamber and the minor axis of the outer jacket, wherein the spacing is from about 0.01 to about 1.5 mm Also shown in FIG. 6 is a screw assembly 330 comprising a screw base 331, and a spindle 332 that supports a plurality of helical threads 333. Also shown is a movable elevator platform 320 comprising an outer periphery 321 that is in frictional contact along the inner surface 120 of the product chamber 110 as the screw base 331 is rotated about its axis to move the movable elevator platform 320 up or down along the inner surface of the product chamber 110. The coupling sleeve 325 extends downward having a threaded section for cooperating and/or mating with the helical threads 333 of the spindle 332.

Referring to FIGS. 2 and 3, in some embodiments, the means for dispensing the consumer care composition from the dispensing package 100 of the present invention can be conventional means known in the art for moving the composition up or down within the package relative to the product chamber 110. For example, in FIGS. 9 and 10 the bottom opening 260 of the outer jacket 200 and the bottom opening 170 of the product chamber 110 may be open and contain the mechanisms for dispensing the consumer care composition through the top opening 160 of the product chamber 110 and top opening 250 of the outer jacket 200. For example, a movable elevator platform 320 may be used wherein the central portion of the movable elevator platform is provided with a coupling sleeve 325 having an inner surface 550 comprising a threaded section 540 for cooperation with the helical threads 333 of the spindle 332. The lower end of the spindle 332 may be axially fixed but rotatable within an opening in the bottom end of the product chamber 110 and outer jacket 200. The spindle 332 may include a tapered section which can be snap fitted using resilient tabs (not shown) in the bottom opening 170 (FIG. 3) of the product chamber 110 to retain the movable platform elevator 320 in the position shown. In some embodiments the screw base may be another rotary grip means, including but not limited to knobs, ratchets, wheels, levers, triggers and the like provided on the lower end of the screw assembly. Rotation of the screw base or external rotary grip permits the user to raise or lower the movable elevator platform 320 relative to the product chamber 110 thereby raising and lowering the composition relative to the product chamber 110. In addition to the spindle, the movable elevator platform, and helical threads, a clicker device (not shown) may also be employed as a means of moving the composition up and down within the product chamber 110. Such mechanisms may be used and are disclosed in U.S. Pat. No. 6,592,278, issued to Holthaus on Jul. 15, 2003 and assigned to Kommanditgesellschaft auf Aktien.

FIG. 7 shows detail 7 of FIG. 5 on an enlarged scale. The top ridged opening 161 at the upper end of the outer surface 130 of the product chamber 110 comprises a groove 164 along the outer surface. The free end 117 of the top ridged opening 161 has a thickness t'. The sidewall 115 of the product chamber 110 has a thickness t. Also, an outer jacket 200 has an inside surface 210. In one embodiment the inside surface 210 of the outer jacket 200 has one or more ribs 212 along the upper end 230 of the outer jacket 200. Also, FIGS. 5 and 7 represent a first product 101 comprising a first dispending package 103 comprising a seal component 310. The outer cap 300 further comprises a bottom end 307 that is adjacent to the outermost ridge 165 of the top ridge opening 161.

Figure 8A:
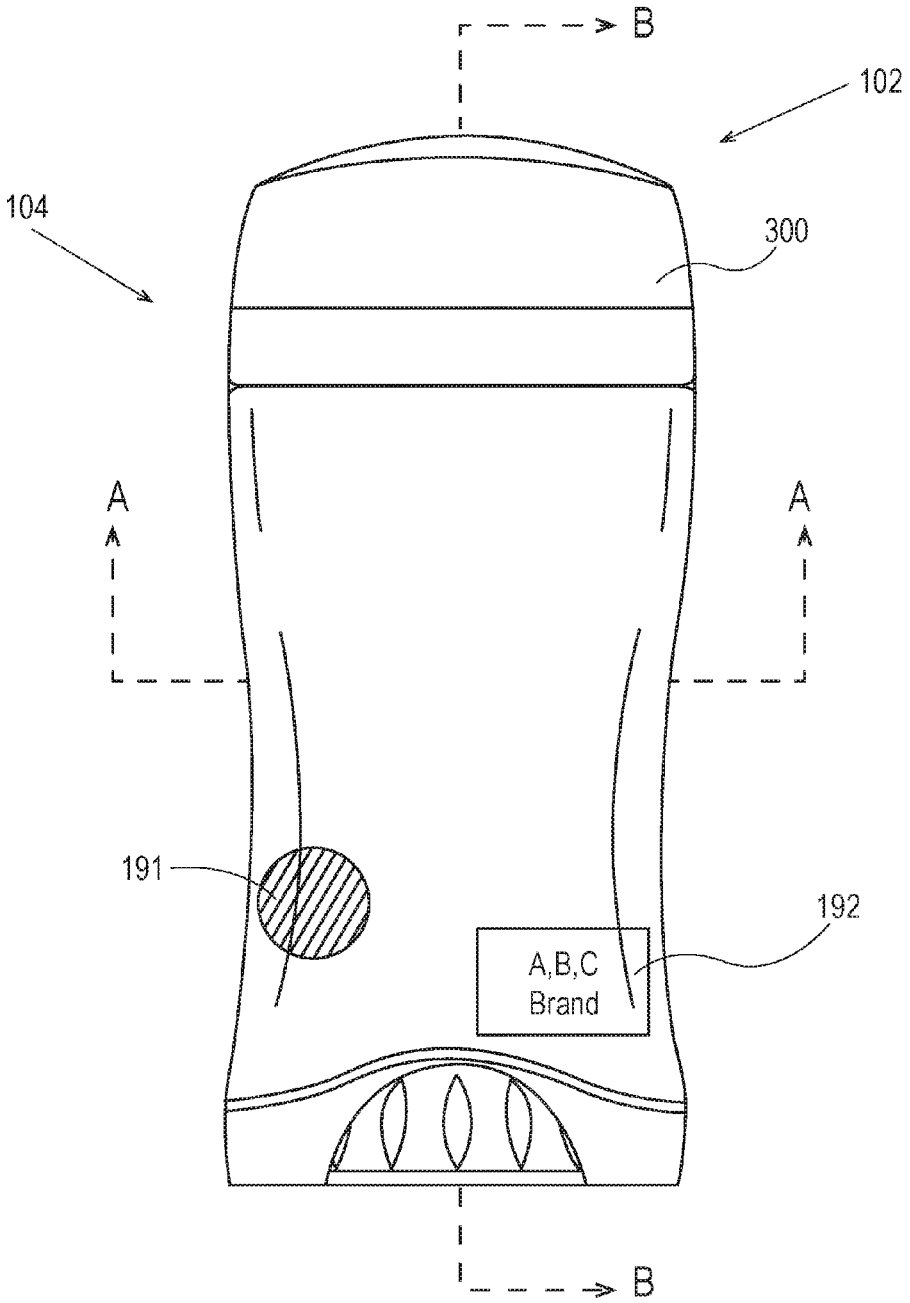
FIG. 8*a* is a front view of one embodiment of the consumer care product and dispensing package shown and described herein.
Figure 8B:
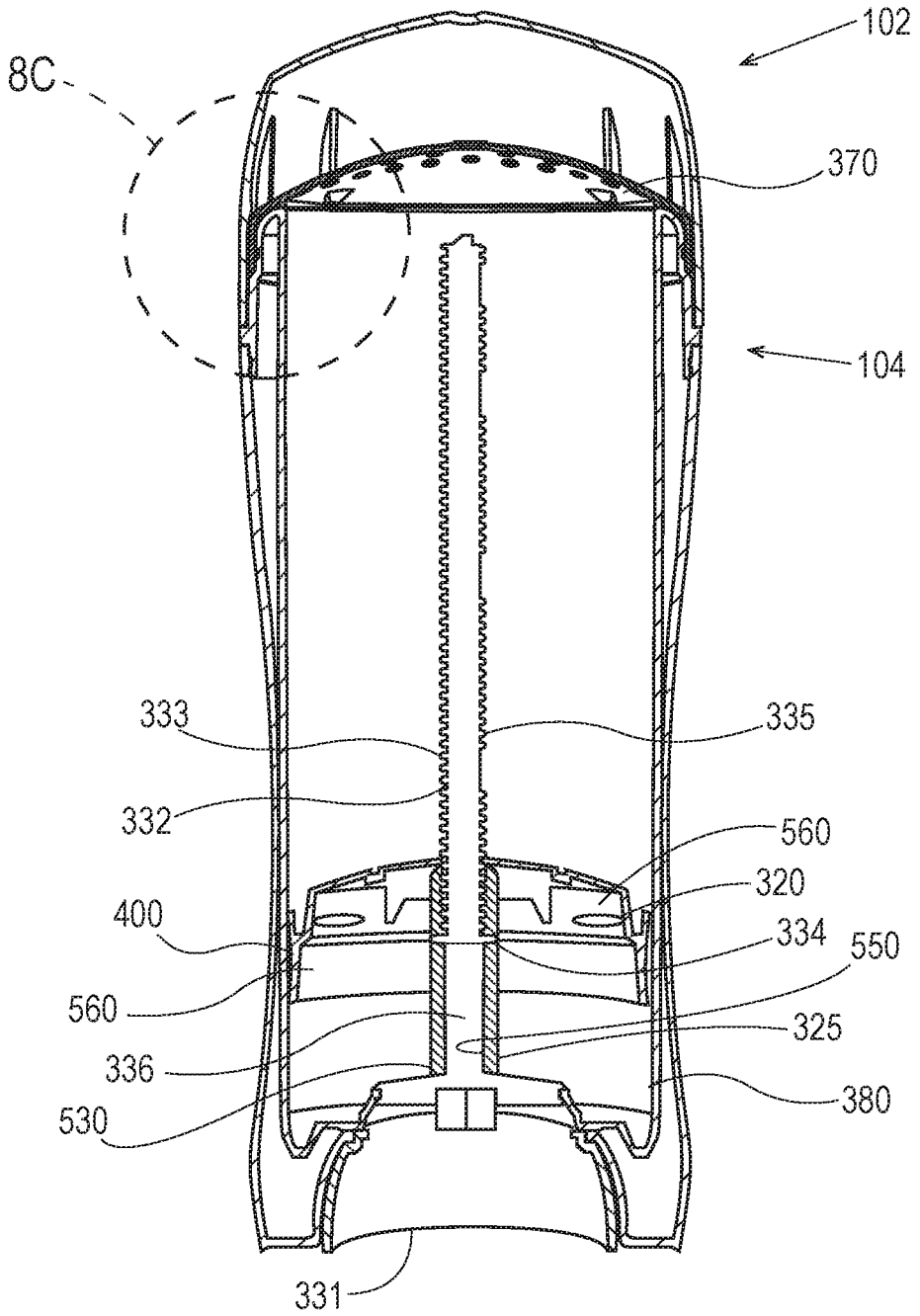
FIG. 8*b* is a cross-sectional front view of the dispensing package taken along the major axis A-A of FIG. 1.
Figure 8C:
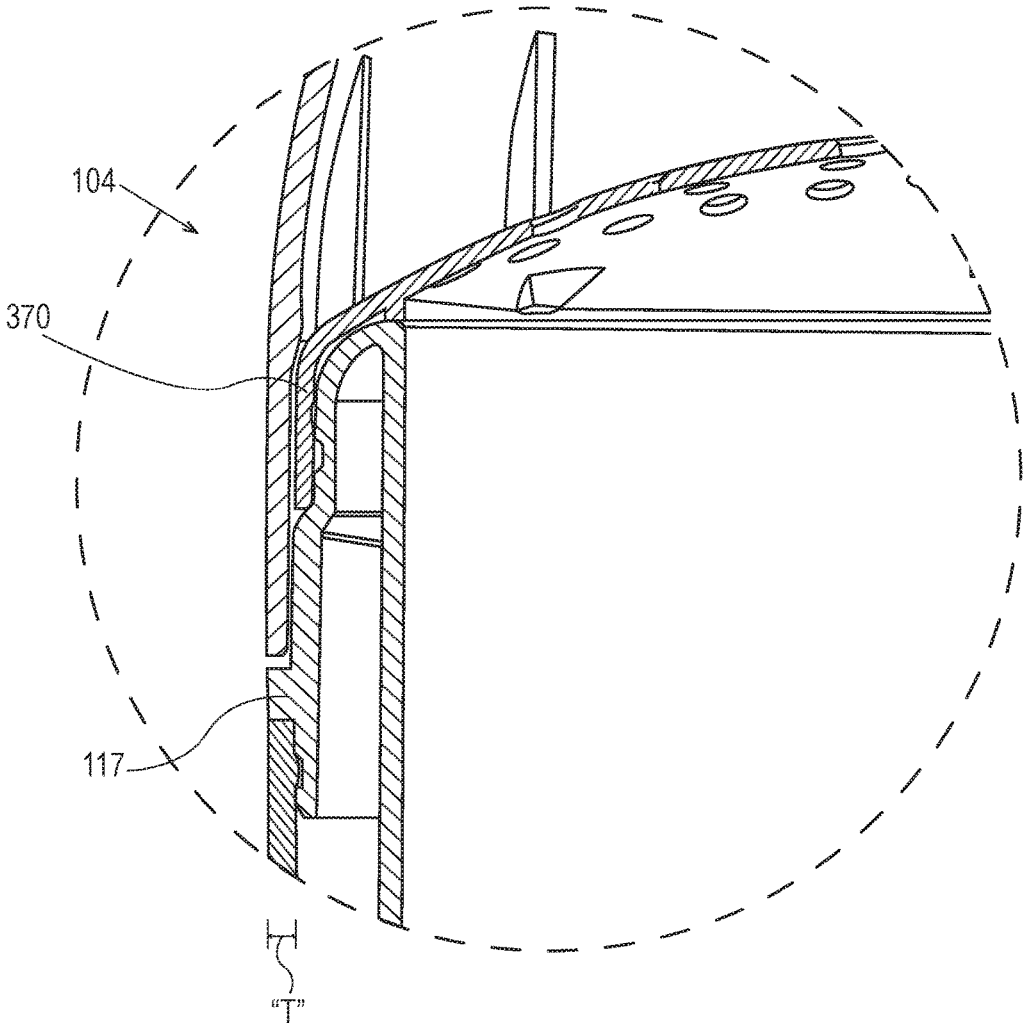
FIG. 8*c* shows detail 8*c* of FIG. 8*b* on an enlarged scale.

FIG. 8*c* shows detail of 8*c* of FIG. 8*b*. Also FIGS. 8*a*, 8*b*, and 8*c* represent a second product 102 comprising a second dispending package 104 comprising a perforated dome cover 370. In some embodiments the outer cap of the first product or first dispending package is dimensioned to be interchangeable with the outer cap 300 of the second product or second dispensing package and the outer cap of the second product or second dispensing package is dimensioned to be interchangeable with the outer cap of the first product or first dispending package and the interchangeable outer caps maintain a retention force of about 1.5 lbs. to about 12 lbs., and/or from about 2 lbs. to about 10 lbs. and/or from about 2 lbs. to about 6 lbs. In an embodiment the outer cap of the first product or first dispending package is substantially the same dimension and/or substantially the same shape, and/or the same dimension or same shape, as the outer cap of the second product or second dispensing package. In another embodiment the outer cap of the first dispensing package has a different shape than the outer cap of the second dispensing package. The first package and the second package may have the same identifier 191 and/or source identifier 192 for example a source identifier indicating that they are made by the same manufacturer.

FIG. 8*b* is a cross-sectional front view of the dispensing package taken along A_A of FIG. 8*a*.

Figure 9:
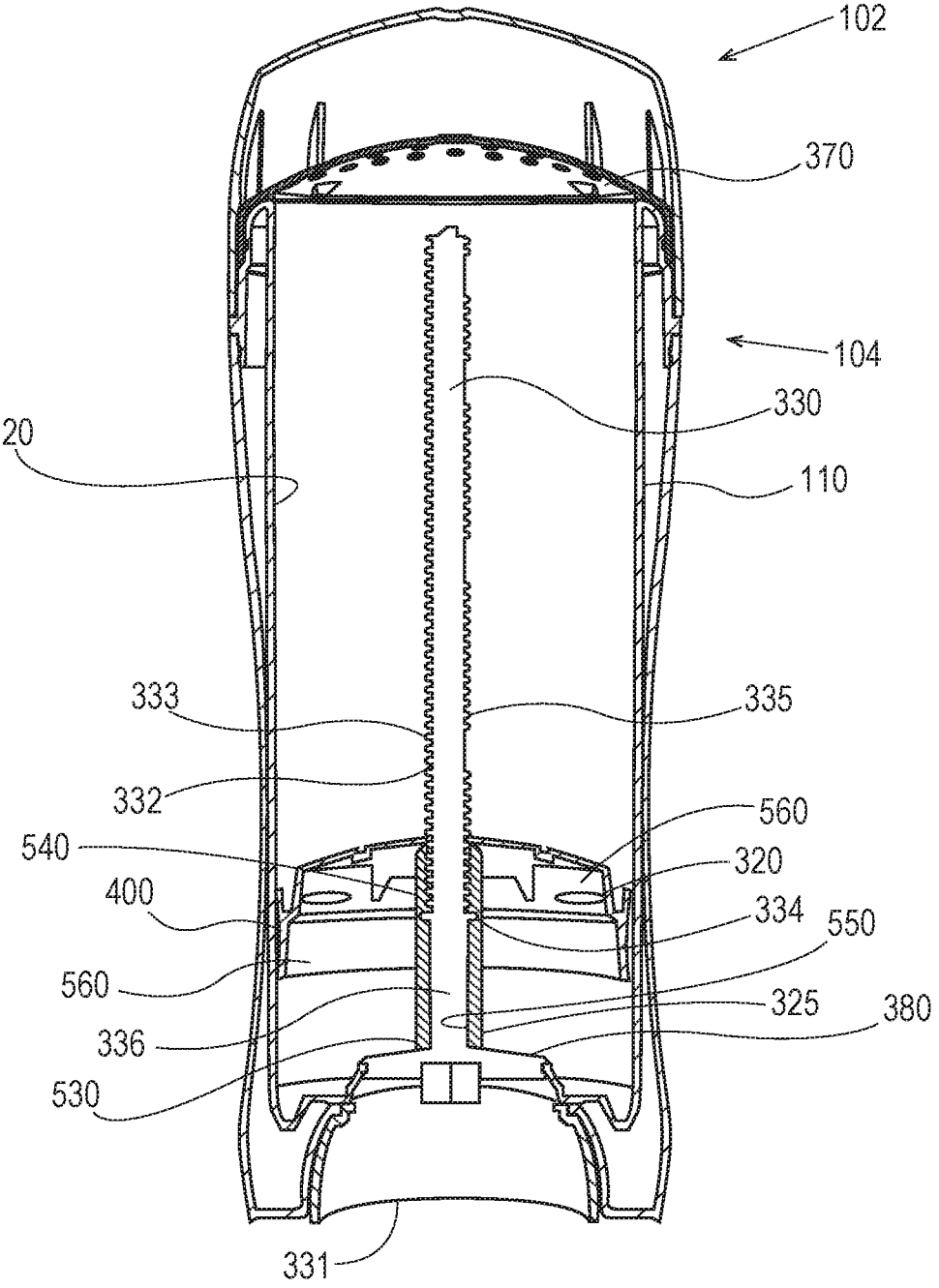
FIG. 9 is cross-sectional front view taken along the major axis of one embodiment of the dispensing packaging shown and described herein with the movable elevator platform at a first fill volume position.
Figure 10:
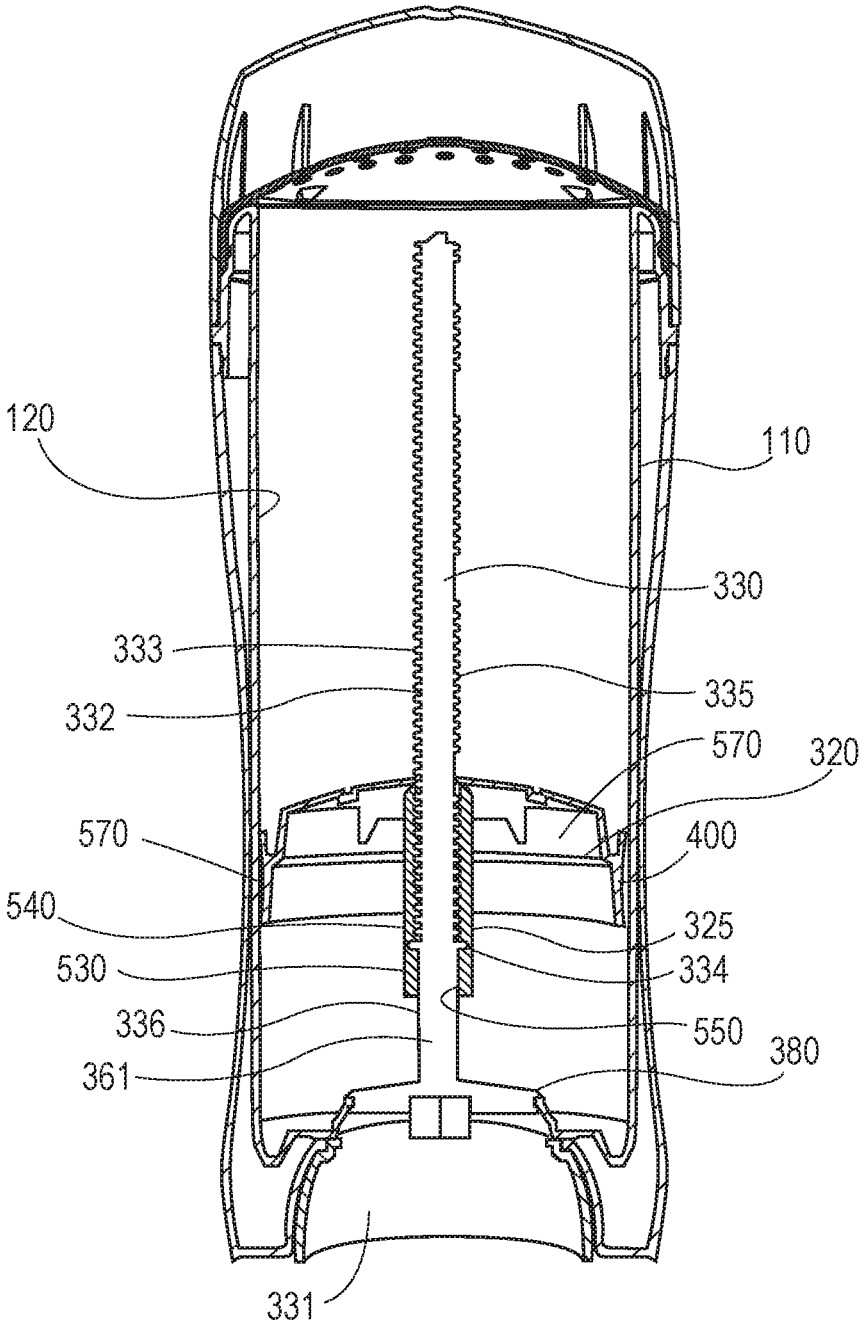
FIG. 10 is cross-sectional front view taken along the major axis A-A of FIG. 1 of the dispensing packaging shown and described herein with the movable elevator platform at a second fill volume position.

FIGS. 9 and 10 are cross-sectional front views taken along the major axis of one embodiment of the dispensing packaging showing the moveable elevator platform at a first fill volume position 560 (FIG. 9). FIG. 10 shows the moveable elevator platform at a second fill volume position 570.

As shown in FIGS. 9 and 10, a movable elevator platform 320 comprises a coupling sleeve 325 having a non-threaded section 530 and a threaded section 540 along an inner surface 550 of the coupling sleeve 325. The dispensing packaging further comprises a screw assembly 330 comprising a spindle 332 that supports threads 333, a seal 334 extending around the circumference of the spindle 332, a threaded first portion 335 coupled to the threaded section 540 along the inner surface of the coupling sleeve 325 of the moveable elevator platform 320. The screw assembly 330 further comprises a non-threaded second portion 336. In this embodiment the seal 334 frictionally engages with the non-threaded section 530 of the coupling sleeve 325, providing a seal that otherwise is maintained during the advancement of the movable elevator platform 320 along an axis from a first fill volume position 560 to a second fill volume position 570. In one embodiment the seal 334, that frictionally engages with the non-threaded section 530 of the coupling sleeve 325, provides a seal that substantially prevents air and/or liquid from passing between the seal 334 and the non-threaded section 530 of the coupling sleeve 325. In another embodiment the frictional engagement of the seal (or the seal) is maintained for a distance corresponding to the distance that the movable elevator platform 320 moves along an axis from a first fill volume position 560 to a second fill volume position 570, the distance being from about 0.1 inch to about 1.0 inch, and/or from about 0.2 inch to about 0.6 inch.

Also as shown in FIGS. 9 and 10 the non-threaded section 530 of the elevator platform 320 is at the lower end of the inner surface 550 of the coupling sleeve 325 and the threaded section 540 is at the upper end of the inner surface 550 of the coupling sleeve 325. The elevator platform 320 further comprises a rim 400 that is in frictional contact with the inner surface 120 of the product chamber 110 along the product chamber major axis 180 and minor axis 190. In an embodiment the seal 334 extends beyond the outer surface 361 of the spindle 332. The seal 334 may have a first diameter and the inner surface 550 of the non-threaded section 530 of the coupling sleeve 325 has a second diameter, wherein the first diameter is greater than the second diameter.

In some embodiments the seal may comprise a continuous bead around the circumference of the outer surface of the spindle as shown in FIGS. 9 and 10. Alternatively the seal may be a thread that is dimensioned to frictionally engage with the inner surface 550 of the non-threaded section 530 of the coupling sleeve 325 providing a seal and the movable elevator platform 320 advances along an axis from a first fill volume position 560 to a second fill volume position 570.

In some embodiments the dispensing packaging 100 further comprises a rachet platform 380 wherein the non-threaded second portion 336 of the spindle 332 extends from the ratchet platform 380 to the seal 334 for a distance of about 5 mm to about 45 mm or from about 8 mm to about 35 mm or from about 10 mm to about 30 mm The spindle 332 may be separately molded and attached to the screw base or the spindle may be molded integrally with the screw base.

In one embodiment the fill volume provides a composition volume of from about 5 ml to about 200 ml and/or from about 25 ml to about 150 ml and/or from about 40 ml to about 100 ml and/or from about 50 ml to about 80 ml. In one embodiment the second fill volume position is about 1% to about 30% greater and/or about 5% to about 25% greater, and/or about 10% to about 20% greater, than the first fill volume position of the same size package. In one embodiment the first fill volume position provides a composition volume from about 15 ml to about 60 ml, or from about 25 ml to about 50 and the second fill volume position provides a composition volume from about 70 ml to about 200 ml or from about 75 ml to about 100 ml.

The size of the package depends, in part, upon the composition to be dispensed, the dose at which it is applied, the dispenser's intended life, the intended use (e.g., value size, samples, travel size, and the like). The volume of the product chamber will typically be larger than the volume of consumer care composition to accommodate component features and production requirements.

In one embodiment the consumer care product is a top fill product, e.g. wherein the composition is filled into the product chamber from the top of the package, comprising an antiperspirant or deodorant composition.

The first dispensing package and second dispensing package comprise a source identifier 192 as shown in FIGS. 1 and 2. The source identifier 192 generally comprises an indicia and may be the similar or may be identical, such as the use of the same brand names, trademarks, company name, etc. The source identifier 192 may be positioned anywhere on the first dispensing package and the second dispensing package, in another embodiment is positioned on the outer jacket, cap, screw base, and/or on the product chamber so that it is visually perceptible to the consumer. In another embodiment the source identifier is positioned on the outside surface of the outer jacket of the consumer care product.

The outer jacket 200 of the present invention may also contribute to a multi-layer package that aids a consumer in selecting their desired product. The outside surface 220 of the outer jacket 200 may aid in communicating product traits to the consumer such as providing a unique shape to the package and/or by providing unique surface features. The outer jacket 200 may comprise an identifier 191 comprising a shape and/or a surface feature, etc. wherein the identifier 191 may be a nondescript shape, a novelty cast, a particular shape including, but not limited to, circle, square, rectangle, oval, star, heart, diamond, polygons and the like, or a shape of the outer jacket 200 such as the shape of the outer jacket shown in FIGS. 1 and 4.

Figure 11:
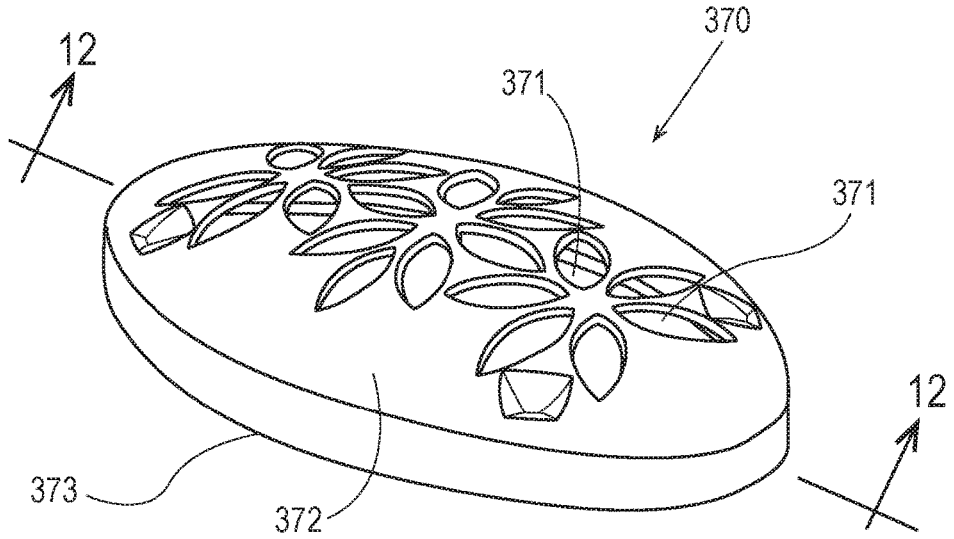
FIG. 11 is a front perspective view of one embodiment of the perforated dome cover of the dispensing package as shown and described herein.
Figure 12:
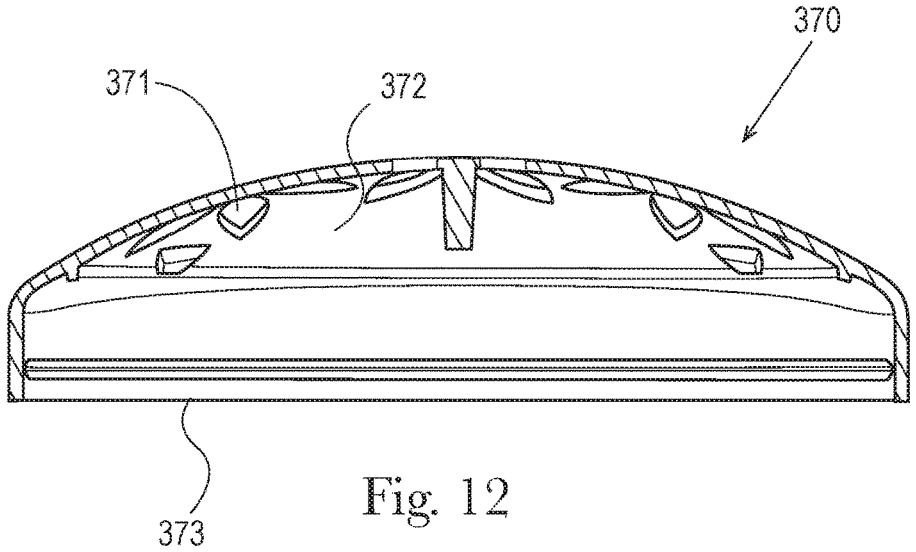
FIG. 12 is a cross-sectional front view of one embodiment of the perforated dome cover taken along the major axis of 12-12 of FIG. 11.

The top opening 160 may optionally comprise an upwardly facing perforated dome cover 370, shown in FIGS. 11 and 12, which may be integrally formed with the product chamber 110 or be a separate member that is formed separately and then attached to the product chamber 110. In an embodiment the perforated dome cover 370 is generally useful for compositions with rheology, hardness, and/or melting profiles that are considered gels or semi-solids. For example soft solids are described in U.S. Patent Publication No. 2013/0108570A1 whereby the rheology profile may include a combination of product hardness in the form of penetration force (gram-force), static yield stress (Pa) values, and/or high shear stress viscosity via methods for determining such characteristics of the rheology profile that are described therein. The perforated dome cover 370 may extend outwardly from and completely surround the periphery of the top opening 160 and/or the top ridged opening 161 of the product chamber 110. The top ridged opening 161 and/or perforated dome cover 370 may comprise a curvature including, but not limited to, convex, concave or a mixture thereof in the cross section, in the direction of the major axis 180 and minor axis 190 of the product chamber 110.

FIG. 12 is a cross-sectional front view of one embodiment of the perforated dome cover 370 taken along the major axis of 12-12 of FIG. 11.

In an embodiment the perforated dome cover may be a convex surface, have a rigid surface, having a plurality of apertures 371 extending through the thickness of the perforated dome cover, and through which the antiperspirant composition is extruded and flows to the intended site of application on the skin. The perforated dome cover 370 thus may have a convex configuration that extends away or protrudes from the product chamber and outer jacket.

The apertures in the perforated dome cover may represent from about 15% to about 80%, or from about 30% to about 60%, or from about 39% to about 50%, of the surface area of the perforated dome cover. In this context, the surface area of the perforated dome cover may correspond to the surface area as measured from a topographical view of the perforated dome cover. The convex configuration of the perforated dome cover may have a radius of curvature of from about 25 mm to about 127 mm, of from about 57 mm to about 69 mm, for a major dimension; a radius of curvature of from about 12 mm to about 39 mm, or from about 22 mm to about 28 mm for a minor dimension. In an embodiment the average aperture area is from about 0.12 $cm^2$ to about 0.50 $cm^2$, or from about 0.2 $cm^2$ to about 0.35 $cm^2$, wherein the aperture areas can have a circular or noncircular configuration. In other embodiments, if a circular configuration the apertures may have an average circular diameter of from about 1.9 mm to about 2.6 mm. In certain embodiments the perforated dome cover thickness is from about 0.25 mm to about 1.53 mm, or from about 0.45 mm to about 1.1 mm The perforated dome cover 370 may also have a bottom edge 373 closest to the top opening 160 of the product chamber 110 and a top edge 372, furthest from the top opening 160 of the product chamber 110. The top edge 372 provides a surface for applying the consumer care composition. When the product chamber 110 is held vertically, with the opening at the top, the bottom edge 373 of the perforated dome cover 370 is below the level of the top edge 372 (with respect to the top opening of the product chamber 110) and adjacent the product chamber 110. The outer surface of the perforated dome cover 370 aids in applying, dosing, and/or delivering the desired amount of the composition to the skin or surface being treated, and may, in addition to having a plurality of apertures, be smooth or textured. Textured applicator surfaces include, but are not limited to dimpling, bumping, electrical discharge machining (EDM), coating, emboss, deboss or mixtures thereof.

In an alternative to the perforated dome cover 370, the top opening 160 may comprise a seal component 310 as shown in FIGS. 4, 5, 6 and 7. The seal component is generally a separate member that is attached to the product chamber 110. In one embodiment the seal component is seated inside the product chamber as shown in FIGS. 5, 6 and 7. The seal component is generally useful for compositions with rheologies that are considered to be solids whereby the consumer removes the seal component prior to first use of the composition. The seal component thus functions to protect the solid composition from degradation or damage during manufacture and storage of the dispensing package. The seal component also serves as a seal to prevent leakage when the package is filled from the bottom with molten liquid composition. This allows the molten liquid to form for example into a dome-like shape as it is cooled. As shown in FIG. 4 the seal component may comprise an upward oriented skirt 311, the skirt 311 having an inner wall surface 312 and an outer wall surface 313. The inner wall surface 312 and the seal component is generally of a size and shape to be seated along the inner surface 120 of the product chamber at the upper dispensing end 140 of the product chamber. The seal component is held in place by frictional engagement between the outer wall surface 313 and the inner surface 120 of the product chamber 110. In one embodiment the top edge 314 of the skirt further comprises a lip 315 (shown in FIG. 7) that extends along at least part of the perimeter of the top edge 314 of the skirt. The lip 315 generally has a circumference that extends outward from the outer wall surface 313 of the skirt 314. In another embodiment the lip circumference is smaller than the circumference of the top ridged opening 161 of the product chamber. In one embodiment the lip helps to properly seat and secure the seal component inside the product chamber while also enabling easy removal prior to use by the consumer.

Figure 13:
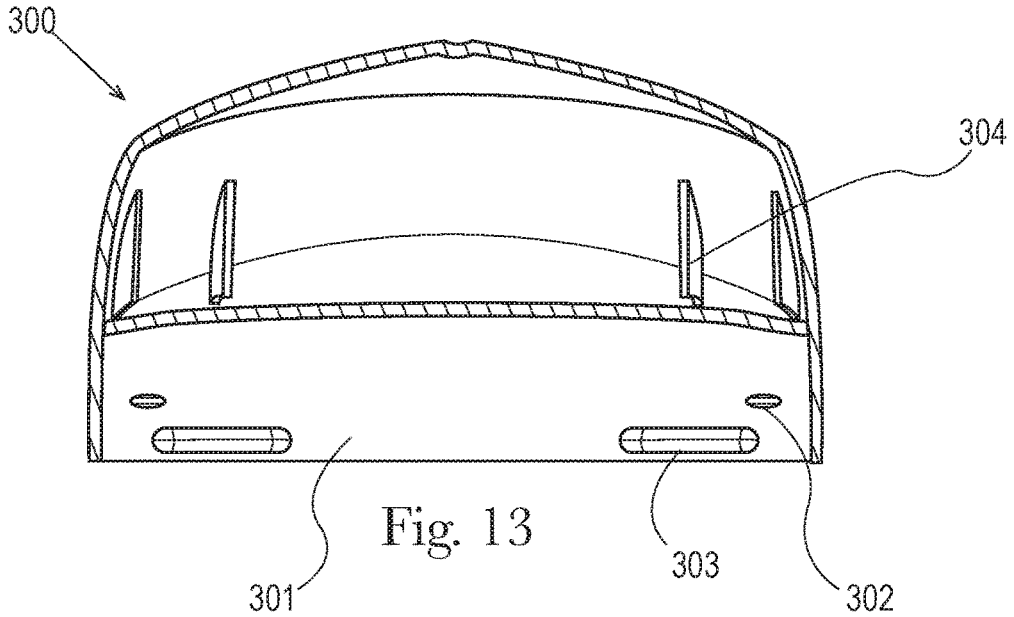
FIG. 13 is cross-sectional front view of one embodiment of the outer cap as shown and described herein taken along the major axis of A-A of FIG. 1 or FIG. 8.
Figure 14:
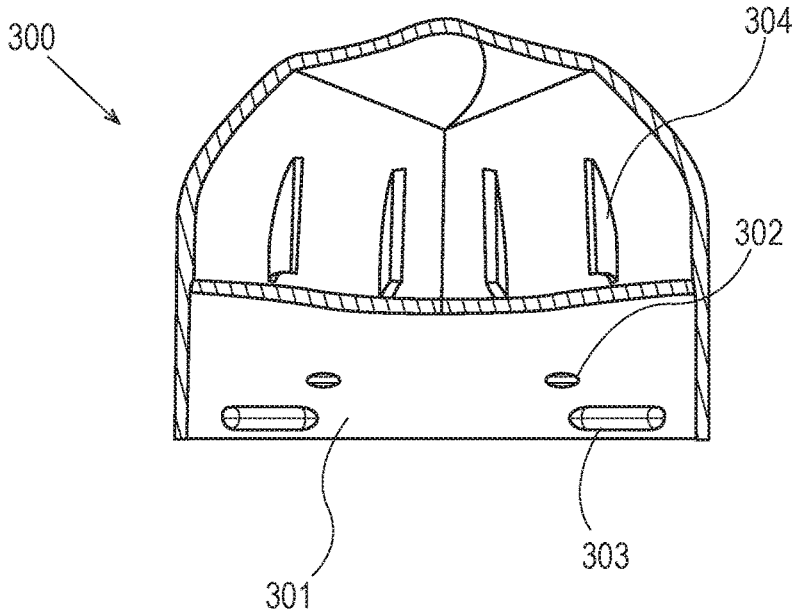
FIG. 14 is cross-sectional side view of one embodiment of the outer cap as shown and described herein taken along the minor axis of B-B of FIG. 1 or FIG. 8.

FIG. 13 is cross-sectional front view of one embodiment of the outer cap as shown and described herein taken along the major axis of A-A of FIG. 1. FIG. 14 is cross-sectional side view of one embodiment of the outer cap as shown and described herein taken along the minor axis of B-B of FIG. 1. As shown in FIGS. 13 and 14, the outer cap 300 comprises an inside surface 301, one or more dome retention beads 302, optionally one or more horizontal ridges 303, and optionally one or more vertical ridges 304.

In one embodiment the design of the product chamber, the top ridged opening, and outer jacket enables the use of the same outer cap whether the dispensing package includes the seal component or the perforated dome cover or neither the seal component or the perforated dome cover. Thus simplified manufacturing processes are achieved and fewer mold components are necessary to manufacture a variety of product offerings (e.g different product sizes, shapes, forms-semi solids, solids and/or gels, etc.).

Referring again to the Figures, in addition to providing a consumer-noticeable, aesthetically-pleasing, readily-identifiable package, the dispensing package 100 of the present invention also offers the ability to reduce complexity related to manufacturing various product forms within a brand. For example, antiperspirant and deodorant compositions are offered by manufacturers in a variety of product forms such as gels, solid sticks and translucent or opaque compositions with varying composition rheologies. Injection molded packaging components must be adapted and designed to avoid both manufacturing and dispensing problems that may arise or be associated with these different product offerings. Also, as the result of these different composition rheologies numerous component parts, sometimes as many as 50-75 different molds, must be developed, used and maintained in the manufacturing injection molding process.

In addition minimizing the amount of plastic used in the dispensing package is also advantageous in terms of cost. However, thin plastic walls are difficult to make in the injection molding processes. In order to house compositions with different rheologies, in the same or similar packaging, manufacturers using interchangeable molds must make sure that the package has enough strength to work for all product sizes, shapes, and composition rheologies. For example, more torque is usually required to move a solid deodorant composition through the dispensing opening of the package compared to liquid compositions. For liquid compositions more frictional engagement may be needed to ensure that the liquid composition does not leak around the circumference of the platform and/or the screw assembly. Thus it may be necessary to provide the packaging with more frictional contact between the outside surface of the movable elevator platform and the inner surface of the product chamber. This may result in more force placed on the walls of the product chamber and consequently the outer jacket.

In certain embodiments the product chamber 110 can be molded of a more rigid, more expensive plastic to hold the consumer care composition with adequate strength while the outer jacket 200 may be molded of a less expensive material. The opposite may also be employed. Also the same or similar materials of equal thickness may be utilized for both the product chamber and the outer jacket of the dispensing package 100. Products sold under the same branding may be manufactured wherein the outer jacket 200 varies as to size, color, shape, etc. to identify the composition while the product chamber 110 is kept constant regardless of the product features. Likewise, the design of the outer jacket 200 could be kept constant, while the outer surface 130 of the product chamber 110 may vary in terms color, surface features, etc.

In an embodiment the present invention can provide a package 100 made of less material, with adequate versatility and strength, whereby the product chamber is in frictional contact with the inside surface of the outer jacket along the product chamber minor axis and the outer jacket minor axis, wherein the product chamber 110 may remain constant as the shape, color, size, etc. of outer jacket 200 is varied.

Identifiers Associated with Multi-Layer Packaging

The present invention provides for identifiers 191 associated with the dispensing package 100 to aid the consumer in readily selecting a consumer care product. The outer surface 130 (and/or inner surface) of the product chamber 110 or the outer jacket 200 may provide a visually appealing identifier 191 that contributes to the particular design features of the invention and aids a consumer in selecting a desired product. For example, the outer surface 130 (and optionally the entire wall) of the product chamber 110 or the outside surface 220 of the outer jacket 200 may have a visual appearance that is transparent, translucent or substantially opaque, or include a portion of the same.

The identifier may be, for example, a nondescript shape, a novelty cast, a particular shape including, but not limited to, circle, square, rectangle, oval, star, heart, diamond, polygons and the like, or a shape of the product.

If both the outer jacket and the product chamber comprise an identifier, thenthe identifier 191 of the outer jacket 200 may communicate with the identifier 191 of the product chamber 110 as part of a multi-layer package design that aids a consumer in the selection of a product. By utilizing a multi-layer design approach, the present invention is able to provide a distinctive appearance, such as three-dimensional appearance at shelf with the use of less packaging material. Additionally, due to the reduced thickness of the packaging, the identifier 191 of the outer jacket 200 can be more dramatic and visual to the consumer. For example, the outer jacket 200 can include an additional molded and casted novelty or promotional feature that is even more visable and thus directly communicates to the consumer as a marketing tool. An identifier associated with the outer jacket and product chamber may alternatively be located in or on other portions of the outer jacket and/or product chamber instead of the outside surfaces, for example, on an inside surface.

Thus in certain embodiments the outer jacket 200 and/or product chamber may be transparent, translucent, substantially opaque or combinations thereof. In embodiments wherein the outer jacket 200 and/or product chamber are either partially or completely transparent or translucent, identifiers that are positioned at some location radially inward from the package's outside surface accordingly are visible and available for consumers to consider when making purchasing decisions. Also, in an embodiment the outer jacket 200 may not be coextensive with the product chamber, such that a portion of the product chamber is exposed to the exterior of the package 100. This exposed portion of the product chamber may contain an identifier or part of an identifier.

When the product chamber is at least partially transparent or translucent, an identifier may be defined by the composition itself (e.g., includes visually detectable beads, pigments (see formulation Example 1 below), color contrasted phases or designs, such as, for example, sparkles, swirls and stripes), or may be defined by a combination of the composition and the product chamber (including aspects attached or engaged therewith).

Overall, the present invention provides for a package that aids a consumer to readily select their desired product, convey performance or product benefits, and better aid a consumer in identifying their desired product while reducing manufacture complexity and cost. The present invention may also minimize manufacturing complexity, enabling a reduction in the number of molds needed to produce a variety of product offerings.

Exemplary Packaging Materials and Manufacturing

A variety of thermoplastic materials or rigid and semi-rigid materials can be used for the product chamber, outer jacket, and other components of the package herein. For example, rigid and semi-rigid materials of the present invention may include, but are not limited to, metals, including but not limited to, aluminum, magnesium alloy, steel; glass; including but not limited to, laminates and polymeric materials such as polypropylene (PP), polyethylene (PE), polystyrene (PS), polyethylene-terepthalate (PET), styrene-acrylonitrile copolymer (SAN), polyethylene-terepthalate copolymers, polycarbonate (PC), polyamides, acrylonitrile-butadiene-styrene (ABS), thermoplastic elastomers, polyoxymethylene copolymer and mixtures thereof.

In one embodiment, the molten thermoplastic material has a viscosity, as defined by the melt flow index (MFI) of about 0.1 g/10 min to about 500 g/10 min, as measured by ASTM D1238 performed at temperature of about 23° C. with a 2.16 kg weight. For example, for polypropylene the melt flow index can be in a range of about 0.5 g/10 min to about 200 g/10 min Other suitable melt flow indexes include about 1 g/10 min to about 400 g/10 min, about 10 g/10 min to about 300 g/10 min, about 20 to about 200 g/10 min, about 30 g/10 min to about 100 g/10 min, about 50 g/10 min to about 75 g/10 min. The MFI of the material is selected based on the application and use of the molded package. For example, thermoplastic materials with an MFI of 5 g/10 min to about 50 g/10 min may be suitable for use as caps and closures for dispensing packaging.

In one embodiment the thermoplastic material can be, for example, a polyolefin. Exemplary polyolefins include, but are not limited to, polypropylene, polyethylene, polymethylpentene, and polybutene-1. Any of the aforementioned polyolefins could be sourced from bio-based feedstocks, such as sugarcane or other agricultural products, to produce a bio-polypropylene or bio-polyethylene.

Polyolefins advantageously demonstrate shear thinning when in a molten state. Shear thinning is a reduction in viscosity when the fluid is placed under compressive stress. Shear thinning can beneficially allow for the flow of the thermoplastic material to be maintained throughout the injection molding process. Without intending to be bound by theory, it is believed that the shear thinning properties of a thermoplastic material, and in particular polyolefins, results in less variation of the materials viscosity when the material is processed at lower pressures.

Other suitable thermoplastic materials include renewable polymers such as nonlimiting examples of polymers produced directly from organisms, such as polyhydroxyalkanoates (e.g., poly(beta-hydroxyalkanoate), poly(3-hydroxybutyrate-co-3-hydroxyvalerate, NODAX (Registered Trademark)), and bacterial cellulose; polymers extracted from plants, agricultural and forest, and biomass, such as polysaccharides and derivatives thereof (e.g., gums, cellulose, cellulose esters, chitin, chitosan, starch, chemically modified starch, particles of cellulose acetate), proteins (e.g., zein, whey, gluten, collagen), lipids, lignins, and natural rubber; thermoplastic starch produced from starch or chemically modified starch and polymers derived from naturally sourced monomers and derivatives, such as bio-polyethylene, bio-polypropylene, polytrimethylene terephthalate, polylactic acid, NYLON 11, alkyd resins, succinic acid-based polyesters, and bio-polyethylene terephthalate.

The suitable thermoplastic materials may include a blend or blends of different thermoplastic materials. For example, the blend may be a combination of materials derived from virgin bio-derived or petroleum-derived materials, or recycled materials of bio-derived or petroleum-derived materials. One or more of the thermoplastic materials in a blend may be biodegradable. Thermoplastic materials may be biodegradable.

The thermoplastic material can also be, for example, a polyester. Exemplary polyesters include, but are not limited to, polyethylene terphthalate (PET). The PET polymer could be sourced from bio-based feedstocks, such as sugarcane or other agricultural products, to produce a partially or fully bio-PET polymer. Other suitable thermoplastic materials include copolymers of polypropylene and polyethylene, and polymers and copolymers of thermoplastic elastomers, polyester, polystyrene, polycarbonate, poly(acrylonitrile-butadiene-styrene), poly(lactic acid), bio-based polyesters such as poly(ethylene furanate) polyhydroxyalkanoate, poly(ethylene furanoate), (considered to be an alternative to, or drop-in replacement for, PET), polyhydroxyalkanoate, polyamides, polyacetals, ethylene-alpha olefin rubbers, and styrene-butadiene-styrene block copolymers. The thermoplastic material can also be a blend of multiple polymeric and non-polymeric materials. The thermoplastic material can be, for example, a blend of high, medium, and low molecular polymers yielding a multi-modal or bi-modal blend. The multi-modal material can be designed in a way that results in a thermoplastic material that has superior flow properties yet has satisfactory chemo/physical properties. The thermoplastic material can also be a blend of a polymer with one or more small molecule additives. The small molecule could be, for example, a siloxane or other lubricating molecule that, when added to the thermoplastic material, improves the flowability of the polymeric material.

Polymeric materials may also include various fillers known to the skilled artisan, such as, for example, mica, interference pigments, wood flour; or materials that are capable of "blooming" to the surface of a molded component. Other additives may include inorganic fillers such calcium carbonate, calcium sulfate, talcs, clays (e.g., nanoclays), aluminum hydroxide, CaSiO3, glass formed into fibers or microspheres, crystalline silicas (e.g., quartz, novacite, crystallobite), magnesium hydroxide, mica, sodium sulfate, lithopone, magnesium carbonate, iron oxide; or, organic fillers such as rice husks, straw, hemp fiber, wood flour, or wood, bamboo or sugarcane fiber.

The product chamber and outer jacket may be manufactured and subsequently assembled. Antiperspirants or other consumer care products may be charged into the product chamber before, after or during the assembly of the product chamber and the outer jacket.

Alternatively, the product chamber and outer jacket may be manufactured, such that the manufacturing process itself imparts at least some connectivity between the components. For example, the product chamber and outer jacket may be formed through a multi-shot molding process or an insert molding process. The molding processes may employ the same or different materials to form the different components. For example, a polymeric material that results in a translucent or transparent part upon curing may be used for the outer jacket and a pigmented polymeric material used for the product chamber. Of course, the product chamber may also be translucent or transparent. The skilled artisan would readily appreciate that the individual components themselves may optionally be made from multiple materials and manufactured through known methods, such as, for example, multi-shot molding and insert molding.

As discussed herein, the rigidity or flexibility may differ between the product chamber and outer jacket. A multi-shot process may be employed, for example, to form a relatively rigid and thin product chamber and a more flexible outer jacket to impart tactile sensorial benefits. Elastomers or elastomer blends may be used to manufacture a relatively thin and flexible outer jacket.

In some embodiments the product chamber has a flexural rigidity of about 1.5 to about 8 or from about 3 to about 7 and the outer jacket has a flexural rigidity of about 1.5 to about 6.5 or from about 1.5 to about 6 or from about 2 to about 5. In some embodiments the assembled product chamber and outer jacket have a combined flexural rigidity of about 1.5 to about 17 and/or about 2 to about 15. The flexural rigidity is measured by the method disclosed in Example 3.

One embodiment of the invention includes a process for ma a consumer roduct, the method comprising the steps of:

(a) providing a product chamber and an outer jacket that at least partially surrounds the product chamber;
(b) forming a material process stream comprising an antiperspirant composition and/or a deodorant composition;
(c) charging a volume of the process stream into either the top opening of the product chamber (e.g. top fill) or the bottom or opening in the lower end of the product chamber (e.g. bottom fill).

In an alternative method the outer jacket may be disposed at least partially around the product chamber after the charging step, to define a double-walled container.

In one embodiment of the invention the product chamber, the outer jacket, outer cap, seal component, perforated dome cover, or other components are made from any of the injection molding processes as disclosed in the following patents or applications: injection molding at low constant pressure in U.S. patent application Ser. No. 13/476,045 filed May 21, 2012, entitled "Apparatus and Method for Injection Molding at Low Constant Pressure" (applicant's case 12127) and published as U.S. 2012-0294963 A1; pressure control in U.S. patent application Ser. No. 13/476,047 filed May 21, 2012, entitled "Alternative Pressure Control for a Low Constant Pressure Injection Molding Apparatus" (applicant's case 12128), now U.S. Pat. No. 8,757,999; non-naturally balanced feed systems, as disclosed in U.S. patent application Ser. No. 13/476,073 filed May 21, 2012, entitled "Non-Naturally Balanced Feed System for an Injection Molding Apparatus" (applicant's case 12130) and published as U.S. 2012-0292823 A1; injection molding at low, substantially constant pressure, as disclosed in U.S. patent application Ser. No. 13/476,197 filed May 21, 2012, entitled "Method for Injection Molding at Low, Substantially Constant Pressure" (applicant's case 12131Q) and published as U.S. 2012-0295050 A1; injection molding at low, substantially constant pressure, as disclosed in U.S. patent application Ser. No. 13/476,178 filed May 21, 2012, entitled "Method for Injection Molding at Low, Substantially Constant Pressure" (applicant's case 12132Q) and published as U.S. 2012-0295049 A1; co-injection processes, as disclosed in U.S. patent application Ser. No. 13/774,692 filed Feb. 22, 2013, entitled "High Thermal Conductivity Co-Injection Molding System" (applicant's case 12361); molding with simplified cooling systems, as disclosed in U.S. patent application Ser. No. 13/765,428 filed Feb. 12, 2013, entitled "Injection Mold Having a Simplified Evaporative Cooling System or a Simplified Cooling System with Exotic Cooling Fluids" (applicant's case 12453M), now U.S. Pat. No. 8,591,219; molding thin wall parts, as disclosed in U.S. patent application Ser. No. 13/476,584 filed May 21, 2012, entitled "Method and Apparatus for Substantially Constant Pressure Injection Molding of Thinwall Parts" (applicant's case 12487); fail safe mechanisms, as disclosed in U.S. patent application Ser. No. 13/672,246 filed Nov. 8, 2012, entitled "Injection Mold With Fail Safe Pressure Mechanism" (applicant's case 12657); high-productivity molding, as disclosed in U.S. patent application Ser. No. 13/682,456 filed Nov. 20, 2012, entitled "Method for Operating a High Productivity Injection Molding Machine" (applicant's case 12673R); molding certain thermoplastics, as disclosed in U.S. patent application Ser. No. 14/085,515 filed Nov. 20, 2013, entitled "Methods of Molding Compositions of Thermoplastic Polymer and Hydrogenated Castor Oil" (applicant's case 12674M); runner systems, as disclosed in U.S. patent application Ser. No. 14/085,515 filed Nov. 21, 2013, entitled "Reduced Size Runner for an Injection Mold System" (applicant's case 12677M); moving molding systems, as disclosed in U.S. patent application 61/822,661 filed May 13, 2013, entitled "Low Constant Pressure Injection Molding System with Variable Position Molding Cavities" (applicant's case 12896P); injection mold control systems, as disclosed in U.S. patent application 61/861,298 filed Aug. 20, 2013, entitled "Injection Molding Machines and Methods for Accounting for Changes in Material Properties During Injection Molding Runs" (applicant's case 13020P); injection mold control systems, as disclosed in U.S. patent application 61/861,304 filed Aug. 20, 2013, entitled "Injection Molding Machines and Methods for Accounting for Changes in Material Properties During Injection Molding Runs" (applicant's case 13021P); injection mold control systems, as disclosed in U.S. patent application 61/861,310 filed Aug. 20, 2013, entitled "Injection Molding Machines and Methods for Accounting for Changes in Material Properties During Injection Molding Runs" (applicant's case 13022P); injection molding to form over molded articles, as disclosed in U.S. patent application 61/918,438 filed Dec. 19, 2013, entitled "Methods of Forming Over molded Articles" (applicant's case 13190P); controlling molding processes, as disclosed in U.S. Pat. No. 5,728,329 issued Mar. 17, 1998, entitled "Method and Apparatus for Injecting a Molten Material into a Mold Cavity" (applicant's case 12467CC); controlling molding processes, as disclosed in U.S. Pat. No. 5,716,561 issued Feb. 10, 1998, entitled "Injection Control System" (applicant's case 12467CR); molding preforms, as disclosed in U.S. patent application 61/952,281, entitled "Plastic Article Forming Apparatus and Methods for Using the Same" (applicant's case 13242P); and molding preforms, as disclosed in U.S. patent application 61/952,283, entitled "Plastic Article Forming Apparatus and Methods for Using the Same" (applicant's case 13243P), all of which is hereby incorporated by reference.

Methods

The retention force for the outer cap is measured as follows: EQUIPMENT: Chatillon Digital Force Tester (Model TCD110 or equivalent) with a Load Cell: 500N [112.405 lbf]. (load cell has a 6 mm thread attachment). The fixtures are adjustable cap-dome-barrel pull grips, inner cap mold, canister mounting plate, Y axis mounting plate, center point rod, dual threaded mounting rod (6 mm top, ¼-20 thread bottom), and 8 GB USB.

Equipment Set-Up:

Mark Centerlines in both the "X" & "Y" directions on the Chatillon T-Slot plate: Attach "center-point rod" to the load cell with threads & nut. Lower the load-cell with mounted center-point rod to ~0.1" above the Chatillon T-Slot plate without letting the rod make contact with the plate. Using a calibrated ruler or tape measure, locate the distance from a point of reference to the center-point for both the X & Y directions. Raise the center-point rod out of the way. Using a straight-edge, mark the center-lines on the T-slot plate. "X" reference line to be parallel to the Chatillon T-Slots. "Y" reference line is 90° perpendicular to the "X" reference line.

Attach "Adjustable cap-dome-barrel pull grips" fixture to the Load Cell (250N) & Chatillon: Attach double threaded mounting rod with nut to the adjustable pull grips fixture (¼-20 threaded side). Remove Load Cell from Chatillon fixture. Loosely attach double threaded mounting rod with nut to the load cell (6 mm threaded side). Attach the sub-assembly from steps 2*a*-2*c* to the Chatillon by bolting the load cell back on. Align adjustable grip fixture so that it is parallel with the "Y-axis" center reference line without allowing the fixtures to touch the T-slot plate. Tighten the nut connecting the dual threaded rod to the load cell with the adjustable grip fixture properly oriented. Raise the cross-head to enable adequate space for base plate attachments.

Attached & Center Base Plates: Center the "Y-axis plate" to Chatillon T-slot "Y-axis" center reference line (created in step 1) using the centering needle (Main). Attach "Y-axis plate" to the Chatillon T-slot plate via (4) T-slot & screw mounts. Slide on the "Canister Mounting Plate" (Black) onto the "Y-axis Plate" (White). Center the "Canister Mounting Plate" to the "X-axis" center reference line (created in step 1) using the centering-needle. Secure the "Y-axis clamp handles" while they are pressed against the "canister mounting plate" on either side.

TEST PROGRAMMING: Create New Method and set-up the configuration. Select "Tension" test type and set up the method parameters. Set-up the method parameters of type-Limit; speed-2000; distance-1000; max load-60000. Select "Data". Select "More". Select "Peak Load" and "OK".

Vertical Pull: Drill or cut a hole at the center point of each cap just big enough for the dual threaded mounting rod to pass through. Place the inner cap mold within the cap. Screw the rod into the threaded inner cap mold to ensure a secure fit. Attach the other end of the dual threaded mounting rod to the load cell. Place canister in the appropriate base plate. Hold canister in place while clamping closed both dista-co clamps on either side of the thumbwheel. Lower the cap onto the canister. Press the "tare" button on the Chatillon to mark this as the temporary starting location. Press the "GREEN" button on the Chatillon to start the test and record the peak force listed. Remove the cap by unscrewing the inner cap mold from the dual threaded mounting rod.

Repeat these steps for each of 30 samples and average the values for the samples.

Method of Making the Dispensing Package

EXAMPLE 1

Figure 15:
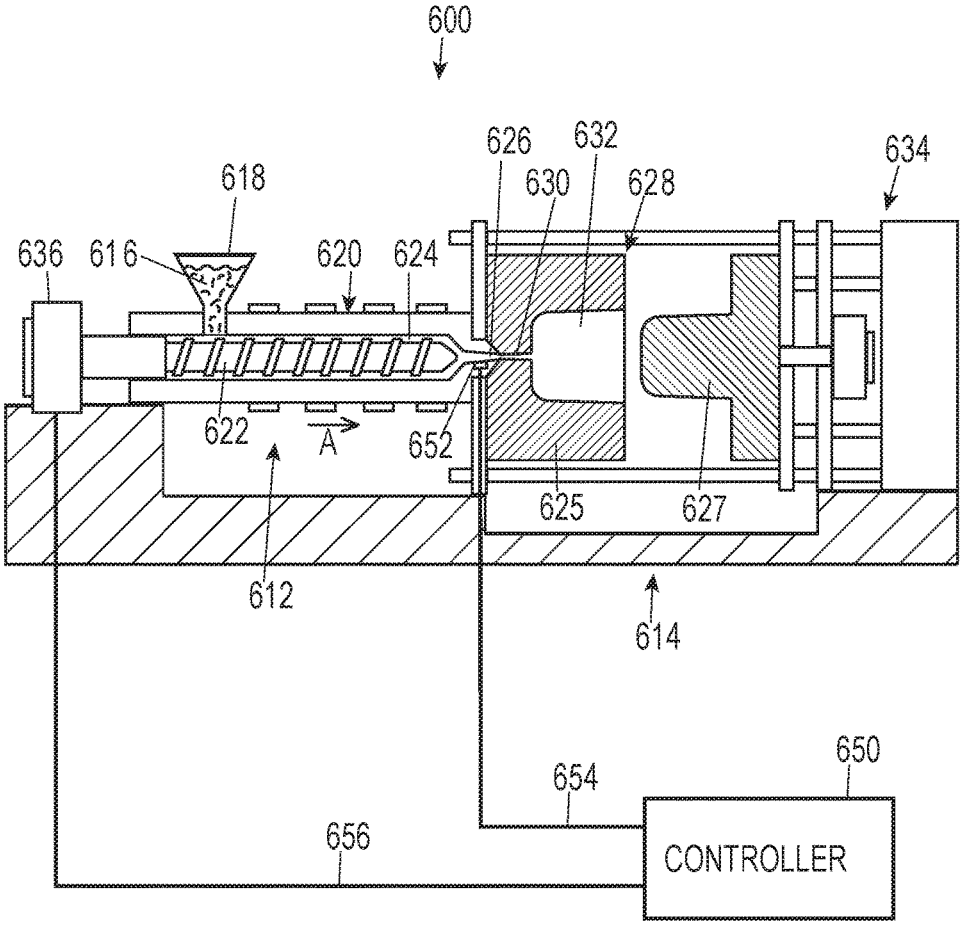
FIG. 15 is a diagrammatic front view of a high velocity injection molding machine according to one embodiment as shown and described herein.

In one embodiment the dispensing package is made via the following process. Referring to FIG. 15 injection molding apparatus 600 for producing thin-walled parts in high volumes, the injection molding apparatus 600 includes an injection system 612 and a clamping system 614. A thermoplastic material, e.g. polypropylene, is introduced to the injection system 612 in the form of thermoplastic pellets 616. The thermoplastic pellets 616 are placed into a hopper 618, which feeds the thermoplastic pellets 616 into a heated barrel 620 of the injection system 612. The thermoplastic pellets 616, after being fed into the heated barrel 620, are driven to the end of the heated barrel 620 by a reciprocating screw 622. The heating of the heated barrel 620 and the compression of the thermoplastic pellets 16 by the reciprocating screw 622 causes the thermoplastic pellets 616 to melt, forming a molten thermoplastic material 624. The molten thermoplastic material is typically processed at a temperature of about 130° C. to about 410° C. The reciprocating screw 622 forces the molten thermoplastic material 624, toward a nozzle 626 to form a shot comprising thermoplastic material, which is injected into a mold cavity 632 of a mold 628 at a substantially constant pressure at less than 6,000 psi (or from about 1000 psi to less than 6,000 psi or from about 2,000 psi to about 5,000 psi). In one embodiment the shot comprising the molten thermoplastic material has a melt pressure that, upon injection into the mold cavity, exceeds a pre-injection pressure of the shot comprising the molten thermoplastic material.

As used herein, the pre-injection pressure of the shot comprising molten thermoplastic material refers to the pressure of the thermoplastic material after it has been heated into a molten state in the heated barrel and prepared into the shot, and just prior to injection of the shot comprising the molten thermoplastic material into the mold cavity or a runner or feed system in fluid communication with the nozzle and the mold cavity.

The term "substantially constant pressure" as used herein with respect to a melt pressure of a thermoplastic material, means that deviations from a baseline melt pressure do not produce meaningful changes in physical properties of the thermoplastic material. For example, "substantially constant pressure" includes, but is not limited to, pressure variations for which viscosity of the melted thermoplastic material do not meaningfully change. The term "substantially constant" in this respect includes deviations of approximately 30% from a baseline melt pressure. For example, the term "a substantially constant pressure of approximately 4600 psi" includes pressure fluctuations within the range of about 6000 psi (30% above 4600 psi) to about 3200 psi (30% below 4600 psi). A melt pressure is considered substantially constant as long as the melt pressure fluctuates no more than 30% from the recited pressure.

The molten thermoplastic material 624 is injected through a gate 630, which directs the flow of the molten thermoplastic material 624 to the mold cavity 632. The mold cavity 632 is formed between first and second mold parts 625, 627 of the mold 628 and the first and second mold parts 625, 627 are held together under pressure by a press or clamping unit 634. The press or clamping unit 634 applies a clamping force in the range of approximately 1000 psi to approximately 6000 psi during the molding process to hold the first and second mold parts 625, 627 together while the molten thermoplastic material 624 is injected into the mold cavity 632. The mold may comprise a single mold cavity or a plurality of mold cavities. The plurality of mold cavities may comprise similar cavities or dissimilar cavities which will yield dissimilar parts. The mold may also comprise grouped family of dissimilar cavities.

Once the shot comprising molten thermoplastic material 624 is injected into the mold cavity 632, the reciprocating screw 622 stops traveling forward. The molten thermoplastic material 624 takes the form of the mold cavity 632 and the molten thermoplastic material 624 cools inside the mold 628 until the thermoplastic material 624 solidifies. Once the thermoplastic material 624 has solidified, the press 634 releases the first and second mold parts 625, 627, the first and second mold parts 625, 627 are separated from one another, and the finished part may be ejected from the mold 628. The mold 628 may include a plurality of mold cavities 632 to increase overall production rates.

A controller 650 is communicatively connected with a sensor 652 and a screw control 636. The controller 650 may include a microprocessor, a memory, and one or more communication links. The controller 650 may be connected to the sensor 652 and the screw control 636 via wired connections 654, 656, respectively. In other embodiments, the controller 650 may be connected to the sensor 652 and screw control 656 via a wireless connection, a mechanical connection, a hydraulic connection, a pneumatic connection, or any other type of communication connection known to those having ordinary skill in the art that will allow the controller 650 to communicate with both the sensor 652 and the screw control 636. There may be intermediary operative units in the communications path between the sensor, the controller, and the screw control.

In the embodiment of FIG. 15, the sensor 652 is a pressure sensor that measures (directly or indirectly) melt pressure of the molten thermoplastic material 624 in the nozzle 626. The sensor 652 generates an electrical signal that is transmitted to the controller 650. The controller 650 then commands the screw control 636 to advance the screw 622 at a rate that maintains a substantially constant melt pressure of the molten thermoplastic material 624 in the nozzle 626. While the sensor 652 may directly measure the melt pressure, the sensor 652 may measure other characteristics of the molten thermoplastic material 624, such as temperature, viscosity, flow rate, etc, that are indicative of melt pressure. The sensor 652 may be located at any location within the injection system 612 or mold 628 that is fluidly connected with the nozzle 626. In one aspect the controller 650 may maintain the pressure according to the input from sensor 652.

The resulting molded part is a thin-walled part having thicknesses disclosed herein. Molded parts are generally considered to be thin-walled when a length of a flow channel L divided by a thickness of the flow channel T is greater than 100 (i.e., L/T>100). In some injection molding industries, thin-walled parts may be defined as parts having an L/T>200, or an L/T>250. The length of the flow channel L is measured from a gate to a flow channel end.

For mold cavities having a more complicated geometry, the UT ratio may be calculated by integrating the T dimension over the length of the mold cavity 632 from a gate to the end of the mold cavity, and determining the longest length of flow from the gate to the end of the mold cavity. The L/T ratio can then be determined by dividing the longest length of flow by the average part thickness. In the case where a mold cavity 632 has more than one gate, the UT ratio is determined by integrating L and T for the portion of the mold cavity 632 filled by each individual gate and the overall L/T ratio for a given mold cavity is the highest UT ratio that is calculated for any of the gates.

The injection molding system injects the molten plastic material into the mold cavity at a substantially constant low pressure. The injection pressure may be less than 6,000 psi. By using a substantially constant low pressure, the molten thermoplastic material maintains a continuous melt front that advances through the flow channel from the gate towards the end of the flow channel. Thus, the plastic material remains relatively uniform at any point along the flow channel, which results in a more uniform and consistent finished package. By filling the mold with a relatively uniform plastic material, the finished molded parts form crystalline structures that have better mechanical and optical properties than conventionally molded plastic parts. Moreover, the skin layers of plastic parts molded at low constant pressures exhibit different characteristics than skin layers of conventionally molded parts. As a result, the skin layers of parts molded under low constant pressure can have better optical properties than skin layers of conventionally molded parts.

Substantially constant and low (e.g., less than 6000 psi) melt pressure within the nozzle and/or during injection of molten polymer into the mold, is maintained which minimizes amount of material adjacent to the walls of the cavity that begins to "freeze," or solidify and cure. During freezing, polymer molecules retain higher levels of flow induced orientation when molecular orientation is locked in the part (e.g. "molded-in" stresses). By reducing this phenomen, mechanical properties are improved. Thus warping or sinking following molding are reduced. The cycle time of each part is maintained with increased machine throughput.

EXAMPLE 2

Antiperspirant Consumer Care Composition

| Ingredient | Weight Percent |
|---|---|
| Cyclopentasiloxane | Quantity Sufficient |
| Aluminum Zirconium Tetrachlorohydrate/gly powder | 25.25 |
| Stearyl alcohol | 12.35 |
| PPG-14 butyl ether | 9.0 |
| Petrolatum | 5 |
| Talc | 2.5 |
| Hydrogenated castor oil | 2.75 |
| Ozokerite | 0.95 |
| Behenyl alcohol | 0.19 |
| Fragrance | 0.75 |
| Pigment[a] | 1.0 |

[a]Pearlescent Pigment Prestige 35322 Twinkling Silver ($TiO_2$ coated mica) commercially available from Eckart Cosmetics Colours of Louisville, KY.

The above exemplary composition may be contained within the product chamber of various packaging embodiments described herein, including, but not limited to, those comprising transparent/translucent product chambers and/or outer jackets.

EXAMPLE 3

Flexural Rigidity of the Dispensing Package

| | Product Chamber (Ave.-Side A) | Product Chamber (Ave.-Side B) | Outer Jacket (Ave.-Side A) | Outer Jacket (Ave.-Side B) |
|---|---|---|---|---|
| Package of Invention | 7.34 ± 0.34 | 7.39 ± 0.36 | 2.74 ± 0.03 | 2.75 ± 0.04 |

-continued

| | | | | |
|---|---|---|---|---|
| Comparative Package A[1] | 6.42 ± 1.42 | 6.03 ± 1.24 | 12.95 ± 0.46 | 13.06 ± 0.42 |
| Comparative Package B[2] | 9.19 ± 0.29 | 8.75 ± 0.31 | 7.00 ± 0.26 | 7.02 ± 0.32 |

| | Assembled Product Chamber and Outer Jacket (Ave.-Side A) | Assembled Product Chamber and Outer Jacket (Ave.-Side B) |
|---|---|---|
| Package of Invention | 12.15 ± 0.52 | 13.18 ± 0.28 |
| Comparative Package B[3] | 24.25 ± 1.15 | 24.70 ± 1.15 |

[1]Commercially available antiperspirant product sold by Unilever under the Tradename Dove ®.
[2]Commercially available antiperspirant product sold by The Procter & Gamble Company under the Tradename Secret ®.
[3]Commercially available antiperspirant product sold by The Procter & Gamble Company under the Tradename Secret ®.

The flexural rigidity of a Package of the Invention, wherein the product chamber and the outer jacket each have a thickness from about 0.45 mm to about 1.2 mm, is determined and compared to the flexural rigidity of Comparative Package A and Comparative Package B.

The flexural rigidity is measured using a tension/compression tester such as an ChattilonTCD 110 with a 110 lb load cell. The dispensing package is placed on the load cell and the force required to flex the walls of the product chamber and/or the walls of the outer jacket is recorded on suitable data acquisition equipment. A small diameter probe (~10 mm OD) is located at a fixed distance (about ~6.35 mm) from the center of the individual package wall to be measured. The center of the package is determined by taking the major axis width and dividing by 2 for a given side. The top to bottom location (as it sits on shelf) is determined by taking the center of the uniform wall section or approximately the total height of the part divided by 2. The flexural rigidity is measured on the front side and the opposite side, Side A and Side B. Take approximately 20 measurements from each side and average the values.

The flexural rigidity is measured as the slope of the force vs. deflection at 0.25 inch deflection. This method may also be used to measure the flexural rigidity of the outer jacket and the product chamber Despite the lower Flexural Rigidity of the outer jacket for the Package of Invention, whereby the walls of both the outer jacket and the product chamber are thin, the Package of the Invention provides the right balance of flexibility and strength between the outer jacket and the product chamber for packaging of a variety of product forms, especially solids, liquids or gels, as described above.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An array of consumer care products, comprising:

a. a first dispensing package comprising:

a product chamber comprising a top opening; an upper dispensing end having a top edge; a major axis, a minor axis, and a sidewall;

a top ridged opening at the upper dispensing end of the product chamber;

an outer cap;

a seal component that covers the top opening;

b. a second dispensing package comprising:

a product chamber comprising a top opening, an upper dispensing end having a top edge; a major axis, a minor axis, and a sidewall;

a top ridged opening at the upper dispensing end of the product chamber;

an outer cap;

a perforated dome cover that covers the top opening;

wherein the outer cap of the first dispensing package is dimensioned to be interchangeable with the outer cap of the second dispensing package and the outer cap of the second dispensing package is dimensioned to be interchangeable with the outer cap of the first dispensing package and the interchangeable outer caps maintain a retention force of about 1.5 lbs. to about 12 lbs.;

wherein the first dispensing package and the second dispensing package have the same source identifier; and wherein the first dispensing package is a bottom fill package and the second dispensing package is a top fill package.

2. The array of claim 1 wherein the outer cap of the first dispensing package has a retention force of about 2 lbs. to about 10 lbs.

3. The array of claim 2 wherein the outer cap of the first dispensing package has a retention force of about 2 lbs. to about 6 lbs.

4. The array of claim 1 wherein the outer cap of the first dispensing package has a thickness of about 0.45 mm to about 1.2 mm.

5. The array of claim 4 wherein the outer cap of the first dispensing package has a thickness of about 0.47 mm to about 1 mm.

6. The array of claim 1 wherein the seal component has a thickness of about 0.45 mm to about 1.2 mm.

7. The array of claim 1 wherein the perforated dome cover has a thickness of about 0.45 mm to about 1.2 mm.

8. The array of claim 1 wherein the outer cap of the first dispensing package has an inside surface comprising one or more horizontal ridges.

9. The array of claim 8 wherein the inside surface of the outer cap of the first dispensing package further comprises one or more vertical ridges, having a top end and a bottom end.

10. The array of claim 9 wherein the bottom end of the vertical ridges of the outer cap of the first dispensing package are located adjacent to the top edge of the upper dispensing end of the product chamber.

11. The array of claim 1 wherein the top ridged opening of the first dispensing package is integral with the product chamber.

12. The array of claim 1 wherein the upper dispensing end of the product chamber of the first dispensing package further comprises a curved downward extension of the sidewall to form a free end and a gap extending along the major axis between the free end and the outer surface of the product chamber.

13. The array of claim 12, wherein the free end has a thickness t' that is substantially non-uniform.

14. The array of claim 1 further comprising a plurality of grooves that are arranged along the periphery of the outer surface of the top ridged opening of the first dispensing package.

15. The array of claim 1 wherein the top ridged opening of the first dispensing package further comprises an outermost ridge.

16. The array of claim 15 wherein the outermost ridge extends outward the farthest distance along the major axis of the product chamber.

17. The array of claim 16 wherein the outer cap of the first dispensing package further comprises a bottom end that is adjacent to the outermost ridge of the top ridged opening.

18. The array of claim 1 wherein the perforated dome cover further comprises a skirt around the periphery and an inside surface, wherein the top ridged opening has an outer surface that is in frictional contact with the inside surface of the perforated dome cover along the product chamber major axis and minor axis.

19. The array of claim 1 wherein the outer cap of the first dispensing package, seal component and perforated dome cover are molded from a polymeric material selected from the group consisting of polypropylene (PP), polyethylene (PE), polystyrene (PS), polyethylene-terepthalate (PET), styrene-acrylonitrile copolymer (SAN), polyethylene-terepthalate copolymers, polycarbonate (PC), polyamides, acrylonitrile-butadiene-styrene (ABS), thermoplastic elastomers, polyoxymethylene copolymer and mixtures thereof.

20. The array of claim 15 wherein the first dispensing package further comprises an outer jacket having an upper end, wherein the upper end is aligned adjacent to the outermost ridge of the top ridged opening.

21. The array of claim 1 wherein the outer cap of the first dispensing package has the same dimensions and shape as the outer cap of the second dispensing package.

22. The array of claim 1 wherein the outer cap of the first dispensing package has a different shape than the outer cap of the second dispensing package.

23. The array of claim 1 wherein the consumer care product comprises an antiperspirant or deodorant composition.

* * * * *